US006645125B1

(12) United States Patent
Stearns et al.

(10) Patent No.: US 6,645,125 B1
(45) **Date of Patent: *Nov. 11, 2003**

(54) METHODS AND APPARATUS FOR LINKING ARM EXERCISE MOTION AND LEG EXERCISE MOTION

(76) Inventors: Kenneth W. Stearns, P.O. Box 55912, Houston, TX (US) 77055; Joseph D. Maresh, P.O. Box 645, West Linn, OR (US) 97068-0645

( * ) Notice: Subject to any disclaimer, the term of this patent is extended or adjusted under 35 U.S.C. 154(b) by 402 days.

This patent is subject to a terminal disclaimer.

(21) Appl. No.: 09/603,476

(22) Filed: Jun. 23, 2000

Related U.S. Application Data

(63) Continuation-in-part of application No. 09/540,061, filed on Mar. 31, 2000.

(60) Provisional application No. 60/140,943, filed on Jun. 28, 1999, and provisional application No. 60/148,304, filed on Aug. 11, 1999.

(51) Int. Cl.[7] ..... A63B 69/16

(52) U.S. Cl. ..... 482/52; 482/62

(58) Field of Search ..... 482/51, 52, 57, 482/62, 66, 70, 71, 72

(56) References Cited

U.S. PATENT DOCUMENTS

| | | | | | |
|---|---|---|---|---|---|
| 5,181,894 | A | * | 1/1993 | Shieng | 482/70 |
| 5,211,613 | A | * | 5/1993 | Friesl | 482/58 |
| 5,938,570 | A | * | 8/1999 | Maresh | 482/57 |
| 5,993,359 | A | * | 11/1999 | Eschenbach | 482/57 |

* cited by examiner

*Primary Examiner*—Nicholas D. Lucchesi
*Assistant Examiner*—Tam Nguyen

(57) ABSTRACT

An exercise apparatus includes a frame, an arm driven member, a leg driven member, and a transmission interconnected between the arm driven member and the leg driven member. At least one of the arm driven member and the leg driven member is pivotally connected to the frame. The arm driven member and the leg driven member are operatively connected in such a manner that the two members are subject to independent influences but nonetheless synchronized with respect to direction of movement.

21 Claims, 35 Drawing Sheets

100
150
160
130
130
170
140
120
120
110

133
133
100
130
130
150
PC
150
140
PF
160
PG
PE
PA
PD
PB
180
120
PH
120
118
110

Fig. 18
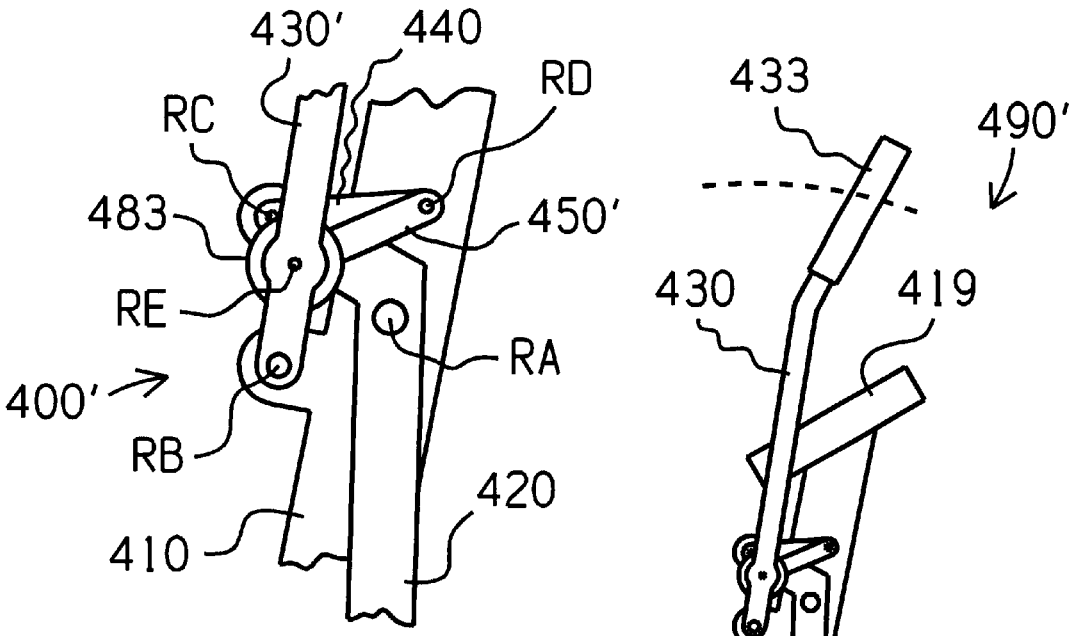
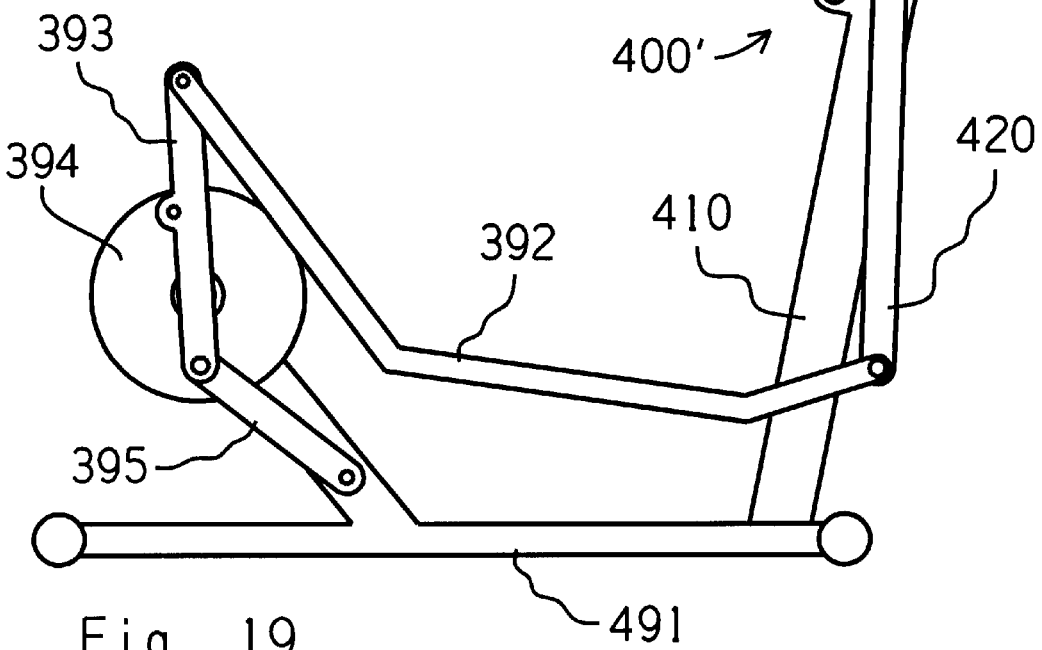
Fig. 19

Fig. 20
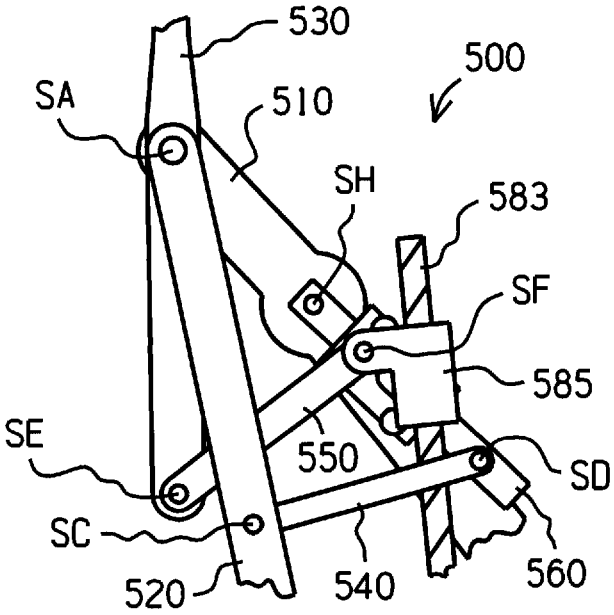
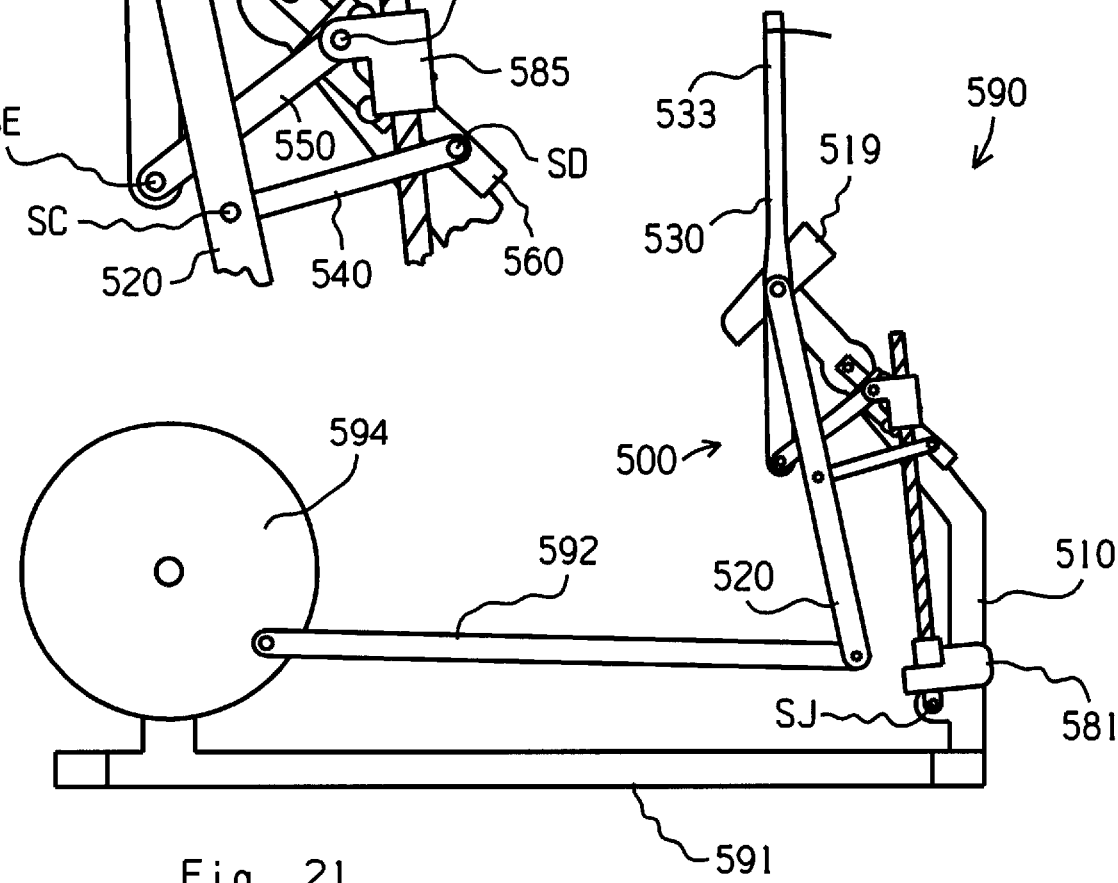
Fig. 21

Fig. 26a
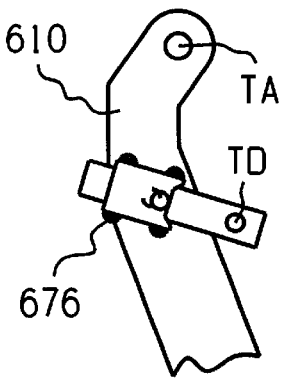
Fig. 26b
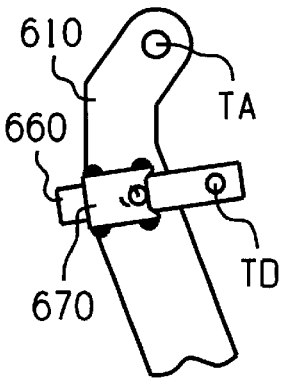
Fig. 26c
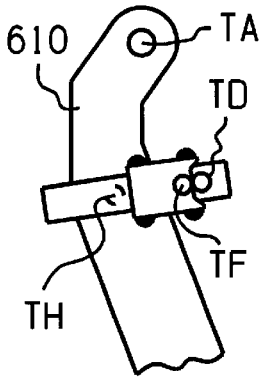
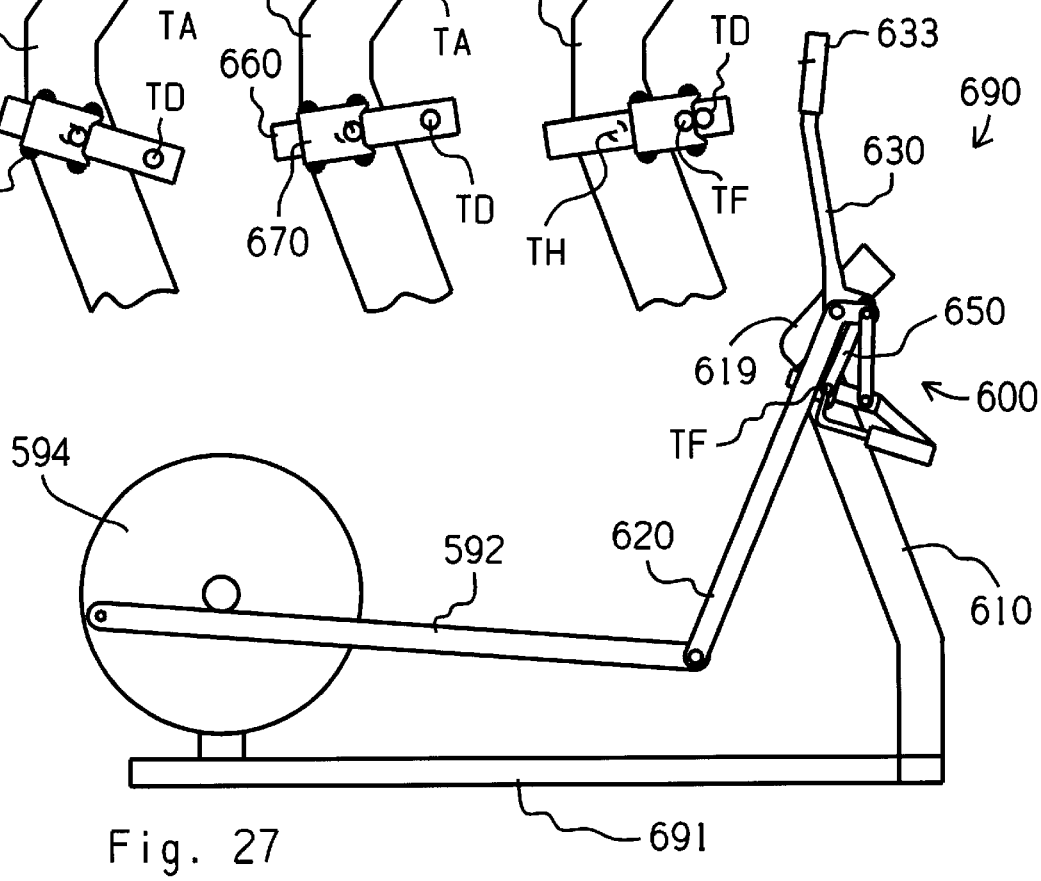
Fig. 27

METHODS AND APPARATUS FOR LINKING ARM EXERCISE MOTION AND LEG EXERCISE MOTION

This application is a continuation-in-part of Ser. No. 09/540,061 filed Mar. 31, 2000 which claims benefit of Provisional Applications No. 60/140,943 and Ser. No. 60/148,304 filed Jun. 28, 1999 and Aug. 11, 1999 respectively.

FIELD OF THE INVENTION

The present invention relates to exercise methods and apparatus and more particularly, to unique linkage arrangements between arm driven members and leg driven members which are suitable for use on various types of exercise equipment.

BACKGROUND OF THE INVENTION

Exercise equipment has been designed to facilitate various exercise motions, many of which incorporate both arm and leg movements. Examples of such equipment include elliptical exercise machines (see U.S. Pat. Nos. 5,242,343, 5,423,729, 5,540,637, 5,725,457, and 5,792,026); free form exercise machines (see U.S. Pat. Nos. 5,290,211 and 5,401,226); rider exercise machines (see U.S. Pat. Nos. 2,603,486, 5,695,434, and 5,997,446); glider/strider exercise machines (see U.S. Pat. Nos. 4,940,233 and 5,795,268); stepper exercise machines (see U.S. Pat. No. 4,934,690); bicycle exercise machines (see U.S. Pat. Nos. 4,188,030 and 4,509,742); and other, miscellaneous exercise machines (see U.S. Pat. Nos. 4,869,494 and 5,039,088). These patents are incorporated herein by reference to show suitable applications for the present invention.

On many such exercise machines, arm driven members and leg driven members are synchronized to facilitate a coordinated "total body" exercise motion. The synchronized motion is considered advantageous to the extent that it makes the equipment relatively easy to use. On the other hand, the perceived quality of exercise tends to exceed the actual quality of the exercise because the arms typically perform very little work. In industry terminology, the arms are generally "along for the ride."

In contrast to the foregoing machines, other exercise machines have been developed to provide independent upper body exercise and lower body exercise. One such machine is the NordicTrack ski machine (see U.S. Pat. No. 4,728,102). On machines of this type, both the perceived quality of exercise and the actual quality of exercise are relatively more strenuous. The trade-off is that many people consider such machines relatively difficult to use, due to the independent nature of the arm motions and the leg motions.

As compared to the ski machines and other machines with independent motion, another shortcoming of the "synchronized" machines is that the handles are often constrained to move back and forth regardless of whether or not the user wishes to move his arms while moving his legs in such cases, the handles can be a nuisance and/or a potential source of injury. One known solution to this problem is to alternatively pin the handles to respective leg driven members or the frame (see U.S. Pat. No. 5,792,026). This approach leaves room for improvement to the extent that exercise activity must stop in order to accommodate insertion of the pins. Also, there is an intermediate configuration, wherein the respective positions of the handles are not dictated by either the leg driven members or the frame. In this regard, the U.S. Pat. No. 5,792,026 patent teaches that the arms may be exercised independent of the legs when the pins are entirely removed. However, this alternative mode of operation simply brings users back to the difficulties often associated with the machines having uncoordinated arm and leg movements, and it does not address the requirement that exercise activity cease in order to change between modes. Recognizing that each of the foregoing types of total body exercise machines suffer certain shortcomings, room for improvement remains with respect to total body exercise machines.

SUMMARY OF THE INVENTION

The present invention provides methods and apparatus for linking a leg driven member and an arm driven member on an exercise machine. The present invention may be implemented in different ways to achieve different results. For example, the present invention may be implemented in a manner which constrains one or more arm driven members to be both (a) synchronized relative to respective leg driven member(s) and (b) movable through a variable range of motion while the leg driven members move through a prescribed range of motion. The present invention may also be implemented in a manner which constrains one or more arm driven members to be both (a) synchronized relative to respective leg driven member(s) and (b) selectively movable (or selectively "stoppable") at any time. The present invention may also be implemented in a manner which constrains one or more arm driven members to be both (a) synchronized relative to respective leg driven member(s) and (b) subjected to resistance independent of the leg driven member(s). The present invention may also be implemented in a manner which constrains the position of one or more arm driven member(s) to be (a) alternatively determined by the frame and respective leg member(s) and (b) always determined by one or the other.

Various embodiments of the present invention generally include a frame; at least one leg driven member; at least one arm driven member; and a transmission assembly interconnected therebetween. Generally speaking, at least one of each leg driven member and arm driven member is pivotally connected to the frame, and at least three discrete connection points are defined between the frame, the leg driven member, and the arm driven member. On some of the embodiments, the transmission assemblies are interconnected between the leg driven member(s) and the arm driven member(s) in a manner which provides all of the attributes described in the preceding paragraph.

On some embodiments, first and second links are pivotally connected to one another and pivotally interconnected between each leg driven member and a respective arm driven member in a manner which constrains the leg driven member and the arm driven member to pivot together in a common rotational direction. On these embodiments, the range of motion of the arm driven member is a function of the location of the pivot axis defined between the first and second links. On other embodiments, each leg driven member and a respective arm driven member are operatively connected to a common rocker link, and the range of motion of the arm driven member is a function of the effective radius of the rocker link for each of the driven members. On still other embodiments, each leg driven member is connected directly to a respective arm driven member at a point of connection, and the range of motion of the arm driven member is a function of the location of a point of connection between the two driven members or between the frame and one of the driven members.

The left and right sides of various embodiments may be linked for contemporaneous adjustment of the arm exercise stroke, or they may be kept separate for independent adjustment and operation. The former arrangement may be considered advantageous to the extent that only one adjustment mechanism is required for left and right arm members, and the two arm members are constrained to operate in like fashion. On the other hand, the latter arrangement may be considered advantageous to the extent that each arm member may be operated independently. The adjustment mechanism may take many different forms, including motorized actuators, clutches, linear springs and dampers, torsional springs and dampers, weights, and simple hole and pin arrangements.

Regardless of the particular arrangement, the present invention also facilitates a method of exercise wherein separate resistance is provided for arm exercise and leg exercise, and/or a distinction is made between the work performed by a user's arms and the work performed by a user's legs. On embodiments with a spring and damper adjustment mechanism, for example, movement of the user's legs may be resisted by an eddy current brake or other known resistance mechanism, while movement of the user's arms may be resisted by the spring and/or the damper. On embodiments with a motorized adjustment mechanism, for another example, a controller may continually sense the force exerted by a user's arms and adjust the leg resistance device to match this force without altering the perceived resistance to leg exercise. In either case, a user interface may be provided to display information and/or change operational parameters in view of how much work is being performed by the user's arms and how much work is being performed by the user's legs.

Several embodiments of the present invention are described in greater detail below with reference to the accompanying figures. However, the present invention is not limited to the depicted embodiments, nor even to the types of machine on which they are shown. Moreover, the present invention is applicable to different combinations of force receiving and/or limb moving members, and additional variations and/or advantages are likely to become more apparent from the detailed description that follows.

BRIEF DESCRIPTION OF THE DRAWING

With reference to the Figures of the Drawing, wherein like numerals represent like parts throughout the several views.

FIG. 18 is a side view of a transmission assembly like the transmission assemblies of FIGS. 14 and 16, but with yet another adjustment mechanism, and with the handlebars available for movement through a relatively large range of motion;

FIG. 19 is a side view of the transmission assembly of FIG. 18 installed on an elliptical exercise apparatus;

FIG. 20 is a side view of another transmission assembly constructed according to the principles of the present invention, with the handlebars available for movement through a relatively small range of motion;

FIG. 21 is a side view of the transmission assembly of FIG. 20 installed on an elliptical exercise apparatus;

FIG. 26*a* is a side view of part of the transmission assembly of FIG. 24, configured so the handlebars are available for movement through a relatively small range of motion;

FIG. 26*b* is a side view of the part of the transmission assembly shown in FIG. 26*a*, but at a different point in an exercise cycle;

FIG. 26*c* is a side view of the part of the transmission assembly shown in FIG. 26*b*, but configured so the handlebars are available for movement through a relatively large range of motion;

FIG. 27 is a side view of the elliptical exercise apparatus of FIG. 25, with the transmission assembly configured as shown in FIG. 26*a*;

DETAILED DESCRIPTION OF PREFERRED EMBODIMENTS

Figure 1:
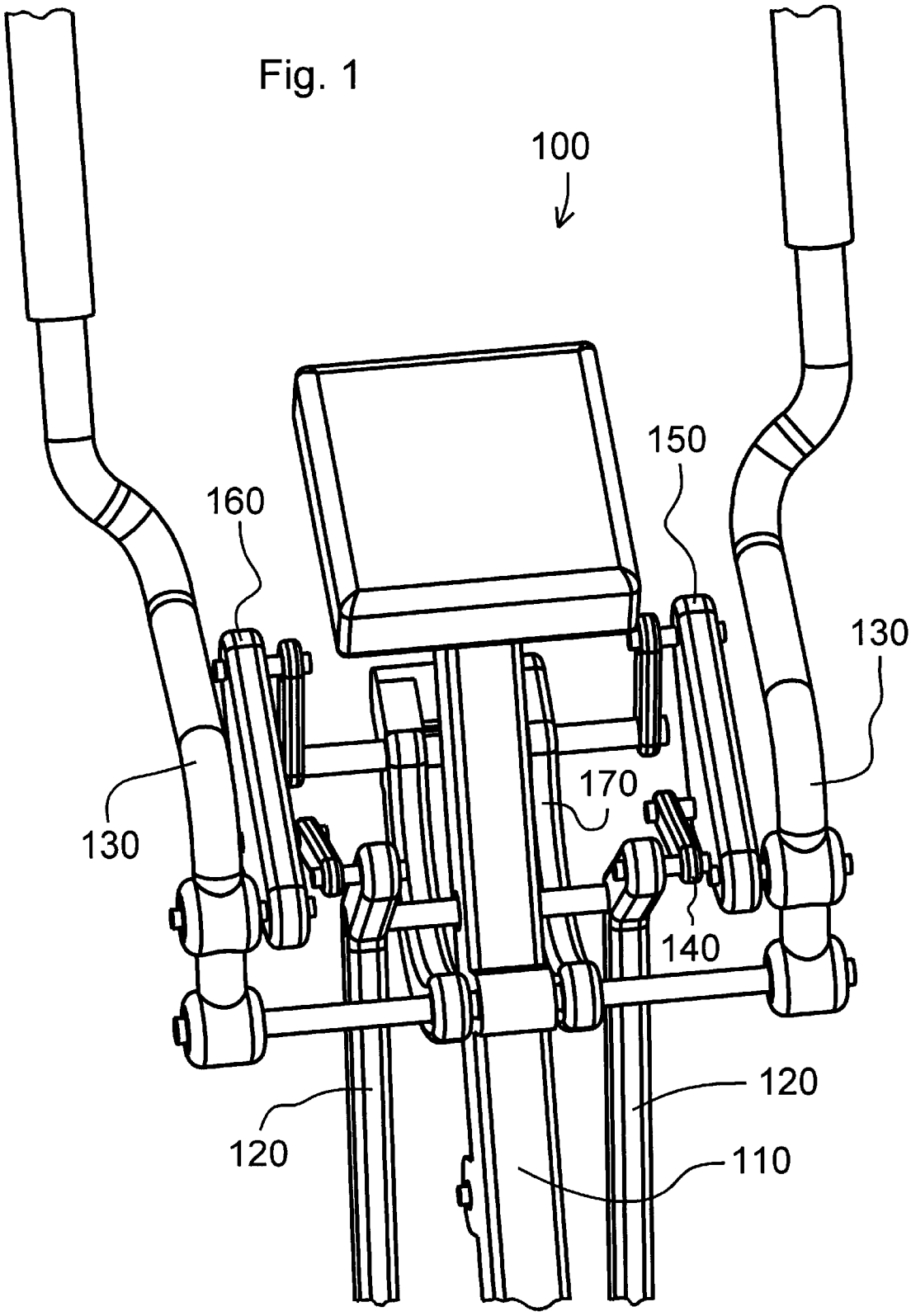
FIG. 1 is a perspective view of a transmission assembly constructed according to the principles of the present invention.

A transmission assembly constructed according to the principles of the present invention is designated as 100 in FIGS. 1–9. The transmission assembly 100 is shown on an exercise apparatus 200, which may be generally described as an elliptical motion exercise machine that is similar in many respects to an exercise machine disclosed in U.S. Pat. No. 5,895,339 (which is incorporated herein by reference). However, the present invention is not limited to this specific type of exercise machine nor to any particular category of exercise machines, but rather, is suitable for use on various sorts of exercise equipment having first and second limb exercising members. Examples of other suitable applications are mentioned above with reference to other prior art patents which are incorporated herein by reference.

Both the transmission assembly 100 and the exercise apparatus 200 are generally symmetrical about a vertical plane extending lengthwise through the center of same, the only exception being the relative orientation of linkage assembly components opposite sides of the plane of symmetry. Generally speaking, the "right-hand" components are one hundred and eighty degrees out of phase relative to the "left-hand" components. However, like reference numerals are used to designate both the "right-hand" and "left-hand" parts, and when reference is made to one or more parts on only one side of an apparatus, it is to be understood that corresponding part(s) are disposed on the opposite side of the apparatus. Also, the portions of the frame which are intersected by the plane of symmetry exist individually and thus, do not have any "opposite side" counterparts. Moreover, to the extent that reference is made to forward or rearward portions, it is to be understood that arrangements could be made for a person to exercise while facing in either direction relative to the linkage assembly.

The transmission assembly 100 is mounted on a frame member 110 and interconnected between a leg driven member 120 and an arm driven member 130. On the embodiment 100, the leg driven member 120 is pivotally connected to the frame member 110 at pin joint or pivot axis PA, and the arm driven member 130 is pivotally connected to the frame member 110 at pin joint or pivot axis PB. However, alternative embodiments of the present invention may be constructed with one of the two driven members pivotally connected to the frame, and the other member supported by the pivotally connected member and/or some other link.

The transmission assembly 100 includes respective first and second "directing" links 140 and 150 which are pivotally connected to one another and operatively interconnected between the leg driven members 120 and the arm driven members 130, and respective first and second "limiting" links 160 and 170 which are pivoted connected to one another and operably interconnected between the frame member 110 and the directing links 140 and 150. The modifiers "directing" and "limiting" are used simply for ease of reference. Other embodiments of the present invention may be constructed with different linkage arrangements.

The leg driven member 120 includes upper and lower segments which extend radially away from the pivot axis PA in generally opposite directions. A distal end of the lower segment is connected to a leg exercise assembly described below. A distal end of the upper segment is pivotally connected to a first portion of the first directing link 140 at pin joint or pivot axis PC. In other words, pivot axis PC is constrained to pivot about pivot axis PA together with the leg driven member 120.

The arm driven member 130 extends radially away from the pivot axis PB and terminates in a handle 133. An intermediate portion of the arm driven member 130 (relatively closer to the pivot axis PB than the handle 133) is pivotally connected to a first portion of the second directing link 150 at pin joint or pivot axis PE. In other words, pivot axis PE is constrained to pivot about pivot axis PB together with the arm driven member 130. A discrete portion of the second directing link 150 is pivotally connected to a discrete portion of the first directing link 140 at pivot axis PD. The distance between the pivot axis PD and the pivot axis PC is approximately equal to the distance between the pivot axis PC and the pivot axis PA, and the pivot axis PD is movable into approximate alignment with the pivot axis PA (see FIGS. 4–5). As the pivot axis PD approaches alignment with the pivot axis PA, the first directing link 140 is essentially limited to pivoting about the pivot axis PA together with the leg driven member 120, thereby imparting minimal translational effect on the second directing link 150. On the other hand, as the pivot axis PD moves away from alignment relative to the pivot axis PA (toward the configuration shown in FIGS. 2–3), the first directing link 140 tends to translate more (and rotate less) relative to the pivot axis PA, thereby imparting a more significant translational effect on the second directing link 150. The arrangement is such that the same side leg driven member 120 and arm driven member 130 pivot in a common rotational direction about their respective pivot axes PA and PB, and it may be configured so that the latter configuration (shown in FIGS. 2–3) provides a full arm swing, and the former configuration (shown in FIGS. 4–5) provides a greatly reduced arm swing or no perceivable arm swing. In this regard, it is to be understood that terms such as "minimal motion" or "minimum stroke length" are intended to describe no movement, as well as relatively little movement. In any event, it may be considered preferable for the handles 133 to always move at least a small amount to (a) entice the user to begin arm exercise; and/or (b) at least convey to the user that the handles 133 are movable.

A first portion of the first limiting link 160 is pivotally connected to a third portion of the second directing link 150 at pin joint or pivot axis PF. A first portion of the second limiting link 170 is pivotally connected to the frame member 110 at the same pivot axis PB as the arm driven member 130. The provision of a common pivot axis PB is a matter of manufacturing convenience rather than operational necessity. A discrete portion of the second limiting link 170 is pivotally connected to a discrete portion of the first limiting link 160 at pin joint or pivot axis PG. In other words, pivot axis PG is constrained to pivot about pivot axis PB together with the second limiting link 170.

A telescoping member 180 is preferably interconnected between the second limiting link 170 (at pivot axis PG) and a trunnion 118 on the frame member 110 (at pin joint or pivot axis PH). The telescoping member 180 includes a rod and a cylinder which are slidable back and forth relative to one another. In a manner known in the art, the telescoping member 180 is configured both to dampen movement of the rod relative to the cylinder and to bias or urge the rod toward a retracted position relative to the cylinder (for example, see U.S. Pat. No. 5,072,928 which is incorporated herein by reference). Additionally, the telescoping member 180 may be configured to limit the extent of telescoping movement, dampen the telescoping movement more in a first direction than in a second direction, and/or facilitate selective adjustment of the telescoping limits, the dampening aspect(s), and/or the spring aspect of the telescoping member 180, if desired.

Figure 8:
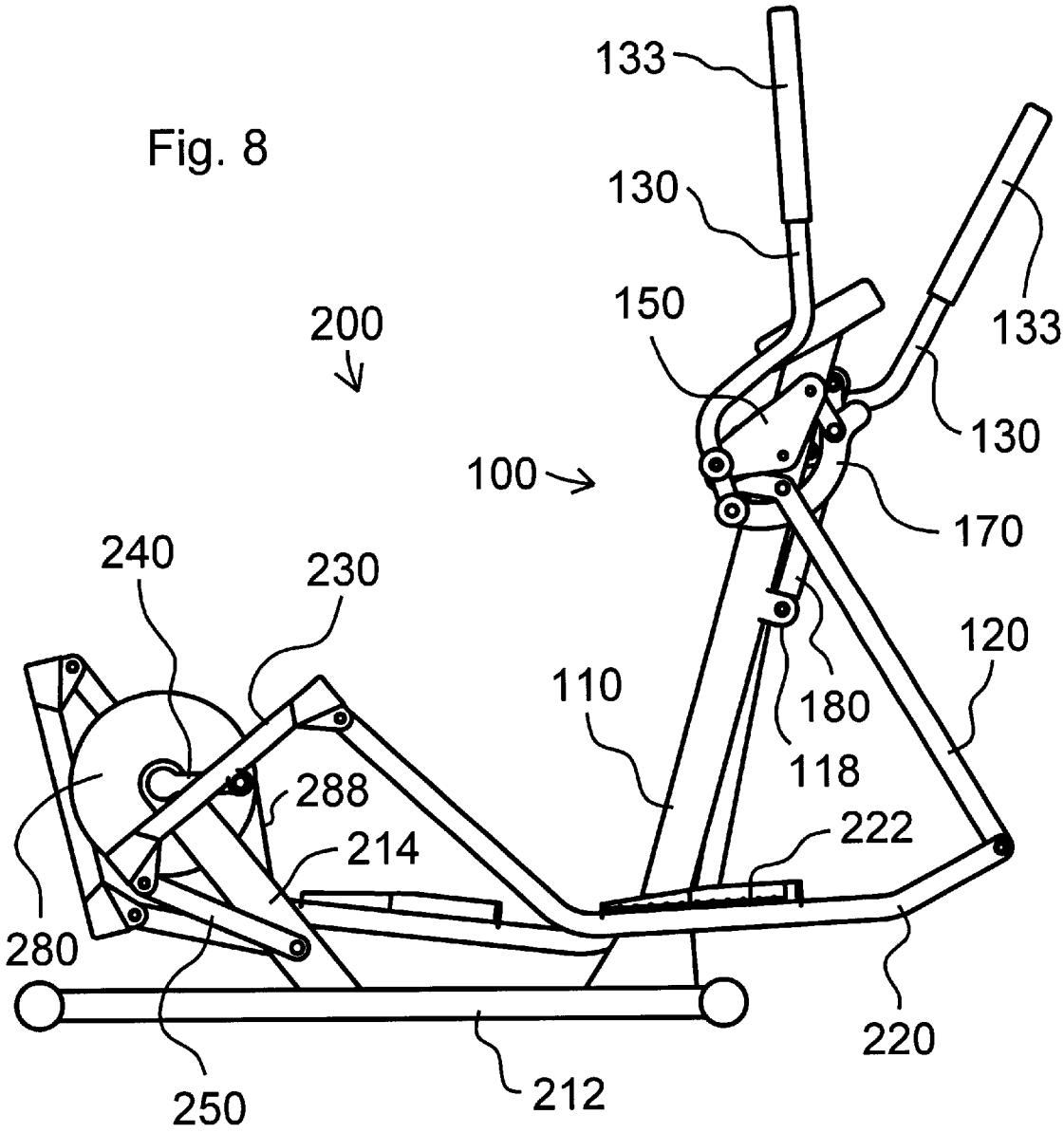
FIG. 8 is a side view of the elliptical exercise apparatus of FIG. 7, with the transmission assembly positioned as shown in FIG. 2.
Figure 9:
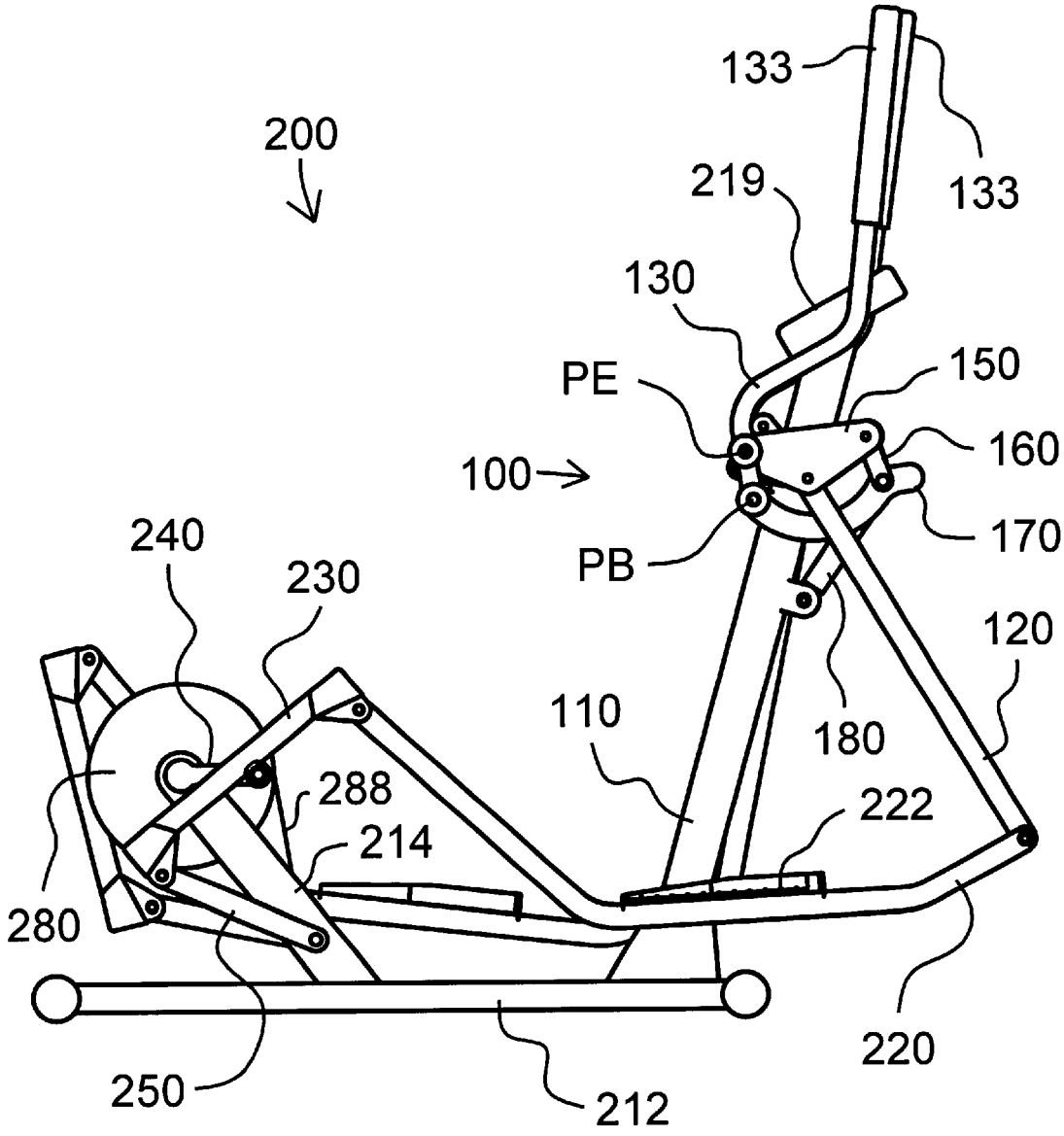
FIG. 9 is a side view of the elliptical exercise apparatus of FIG. 7, with the transmission assembly positioned as shown in FIG. 4.

In the absence of any outside influence, the spring in the telescoping member 180 pulls the second limiting link 170 forward and downward relative to the frame 110 (away from the position shown in FIG. 8, and toward the position shown in FIG. 9). In other words, the telescoping member 180 biases the assembly 100 toward the minimum stroke length configuration shown in FIGS. 4–5 and 9. The weight of the links 150, 160, and 170 also contributes to this bias force, and it may even be sufficient to obviate the spring on an alternative embodiment. In any event, the damper in the telescoping member 180 prevents the assembly 100 from moving suddenly from either extreme to the other. Depending on the extent of the bias force, it may be desirable for the damper to impose a greater restriction on retraction (as opposed to extension) of the telescoping member 180.

In response to an appropriate outside influence, the second limiting link 170 is pivotal in an opposite direction, upward and rearward about the pivot axis PB. On the embodiment 100, this so-called "outside influence" is user applied force against one or both of the handles 133. In this regard, the user can increase the arm exercise stroke (while exercising) by pulling and/or pushing on respective handles 133 in a manner which is preferably coordinated with movement of the leg driven members 120. Generally speaking, the length of the arm exercise stroke is a function of force exerted by the user against the handles 133 (under a given set of operating parameters). On the embodiment 100, the dampening feature of the telescoping member 180 limits how much the length of the arm exercise stroke can change during a single exercise cycle. Regardless of the magnitude of the arm exercise stroke, the handles 133 remain synchronized with the leg driven members 120 if desired, the available range of motion may be selectively limited by adjusting a stop inside the telescoping member 180 and/or relative to one of the links in the assembly 100.

On other embodiments, the telescoping member 180 may be eliminated or replaced by other suitable devices. For example, a linear actuator may be substituted for the telescoping member 180, in which case the assembly may be adjusted automatically and/or more rapidly. In this situation, the "outside influence" may be a control signal generated by (a) the user pushing a button on the console 219 or either handle 133; (b) a sensor detecting the presence or absence of the user's hands on the handles 133; (c) a sensor detecting the user's level of exertion (exerted force and/or heart rate, for example) for comparison to a target level or range; (d) an automated program; and/or (e) a person other than the user (such as a trainer) who is in communication with the apparatus (via remote control and/or the internet, for example) Independent arm resistance may still be provided by adjusting the leg resistance to counteract the force exerted through the handles 133.

Figure 7:
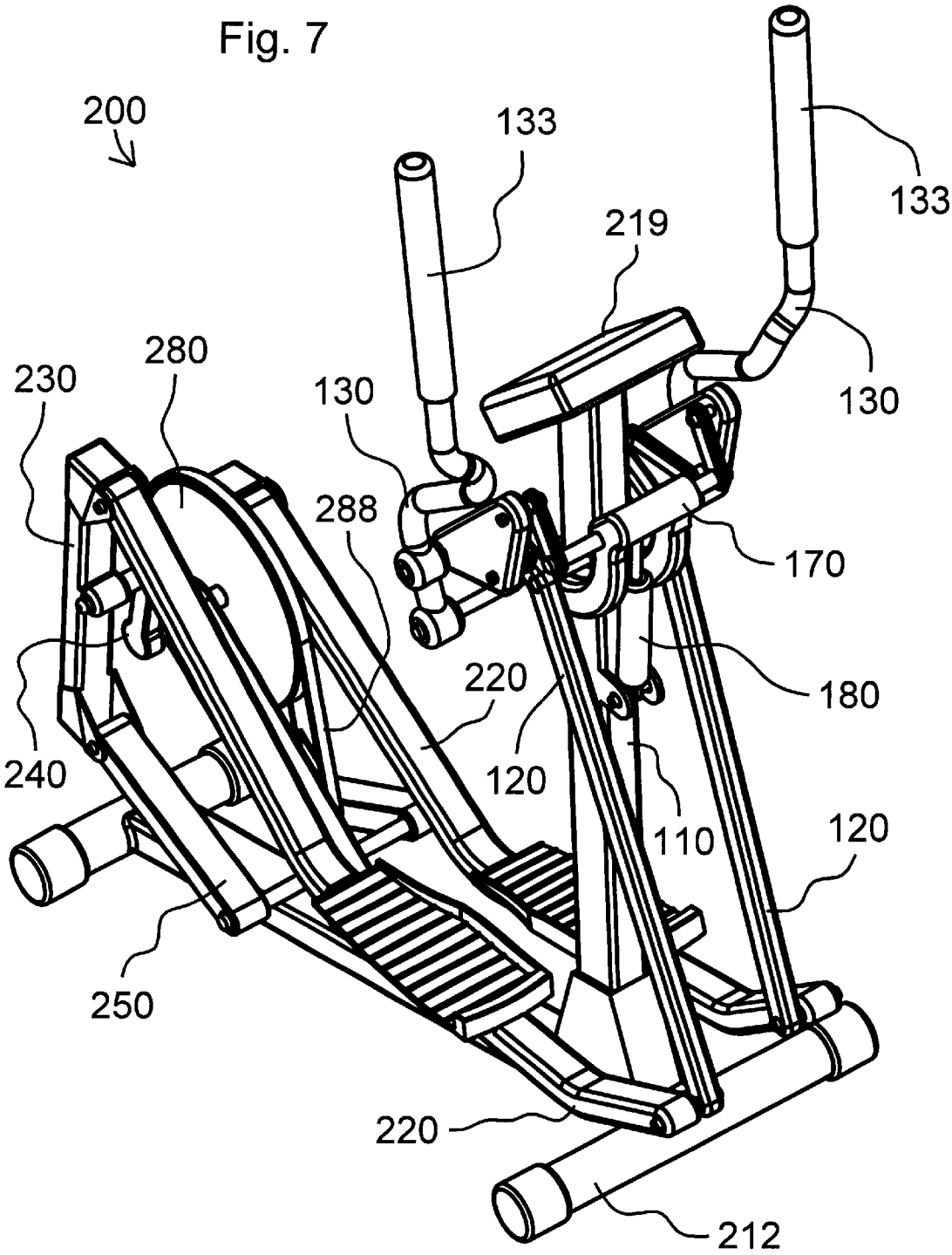
FIG. 7 is a perspective view of the transmission assembly of FIG. 1 installed on an elliptical exercise apparatus.

The transmission assembly 100 is shown on an elliptical exercise apparatus 200 in FIGS. 7–9. As noted above, the leg exercising portion of the apparatus 200 is similar in many respects to the exercise machines disclosed in U.S. Pat. No. 5,895,339 (which is incorporated herein by reference). The apparatus 200 includes a base 212 which extends from a forward end to a rearward end and is configured to rest upon a floor surface. The frame member 110 is a forward stanchion which extends upward from the base proximate the forward end. A rearward stanchion or frame member 214 extends upward from the base 212 proximate the rearward end. A linkage assembly (including left and right leg driven members 120) is movably interconnected between the rearward stanchion 214 and the forward stanchion 110. Generally speaking, the linkage assembly moves relative to the frame in a manner that links pivoting of the leg driven members 120 to generally elliptical motion of foot platforms 222. The term "elliptical motion" is intended in a broad sense to describe a closed path of motion having a relatively longer first axis and a relatively shorter second axis (which is perpendicular to the first axis).

In addition to the left and right leg driven members 120, the linkage assembly generally includes left and right foot supporting members 220, left and right connector links 230, left and right cranks 240, and left and right rocker links 250. On each side of the apparatus 200, a crank 240 is rotatably mounted on the rear stanchion 214 via a common crank shaft. An intermediate portion of each connector link 230 is rotatably connected to a respective crank 240. A first distal end of each connector link 230 is rotatably connected to a respective rocker link 250, and an opposite, second distal end of each connector link 230 is rotatably connected to a rearward portion of a respective foot supporting link 220. An opposite, forward portion of each foot supporting link 220 is rotatably connected to a respective leg driven member 120. An intermediate portion of each foot supporting link 220 supports a respective foot platform 222.

Figure 2:
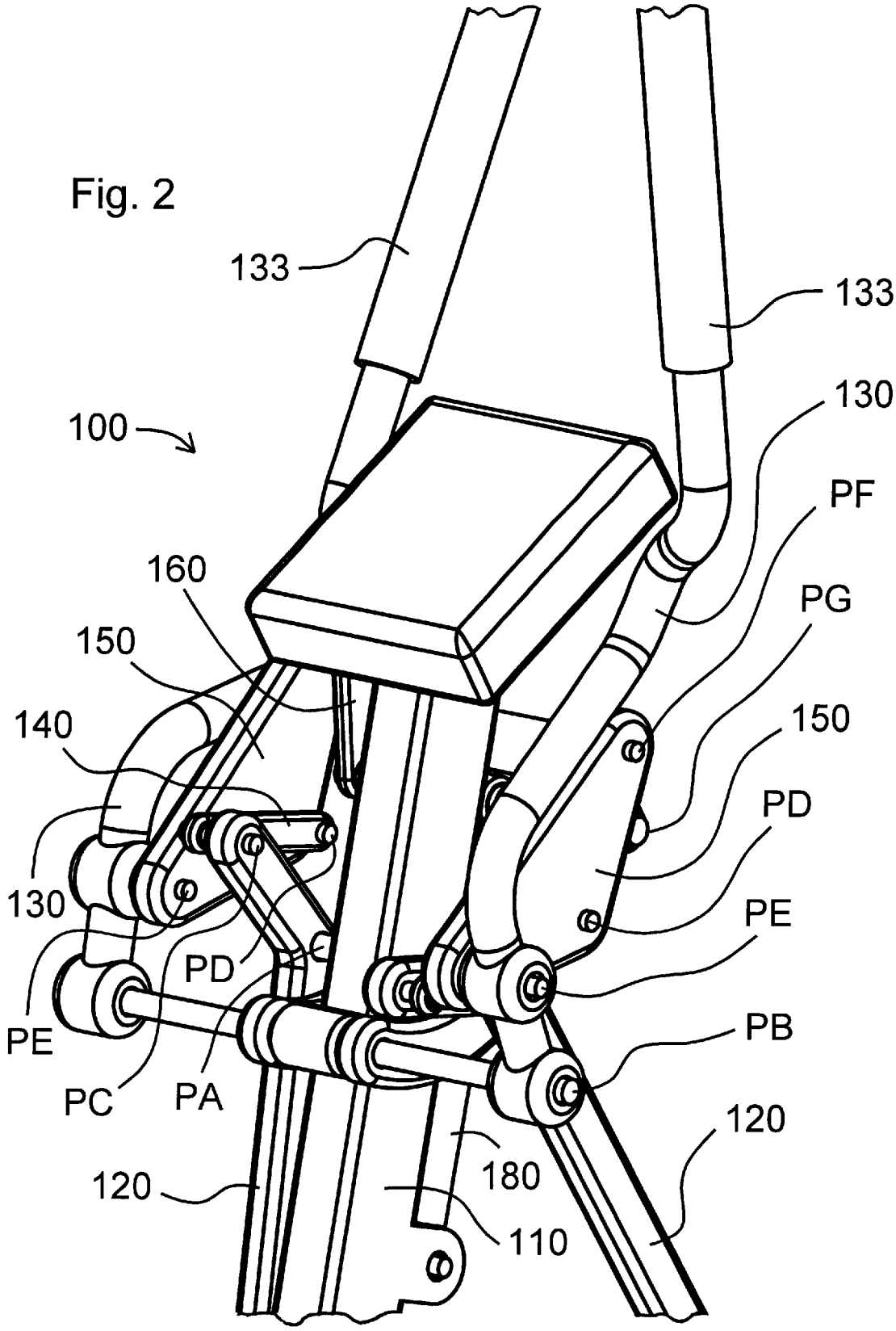
FIG. 2 is another perspective view of the transmission assembly of FIG. 1, with the right leg driven member at a relatively forward position, and the handlebars available for movement through a relatively large range of motion.
Figure 3:
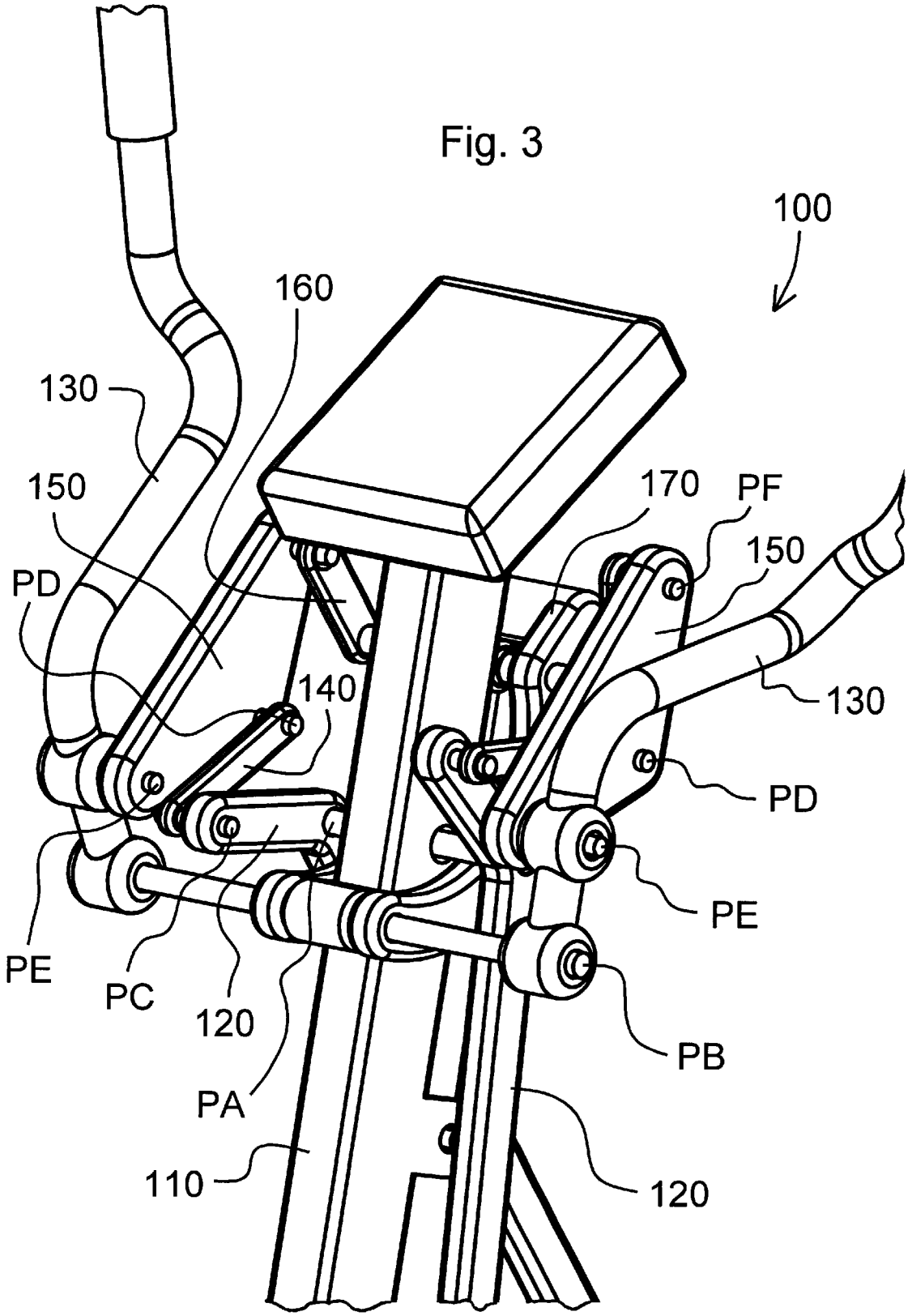
FIG. 3 is the same perspective view of the transmission assembly of FIG. 2, with the right leg driven member at a relatively rearward position, and the handlebars available for movement through a relatively large range of motion.
Figure 4:
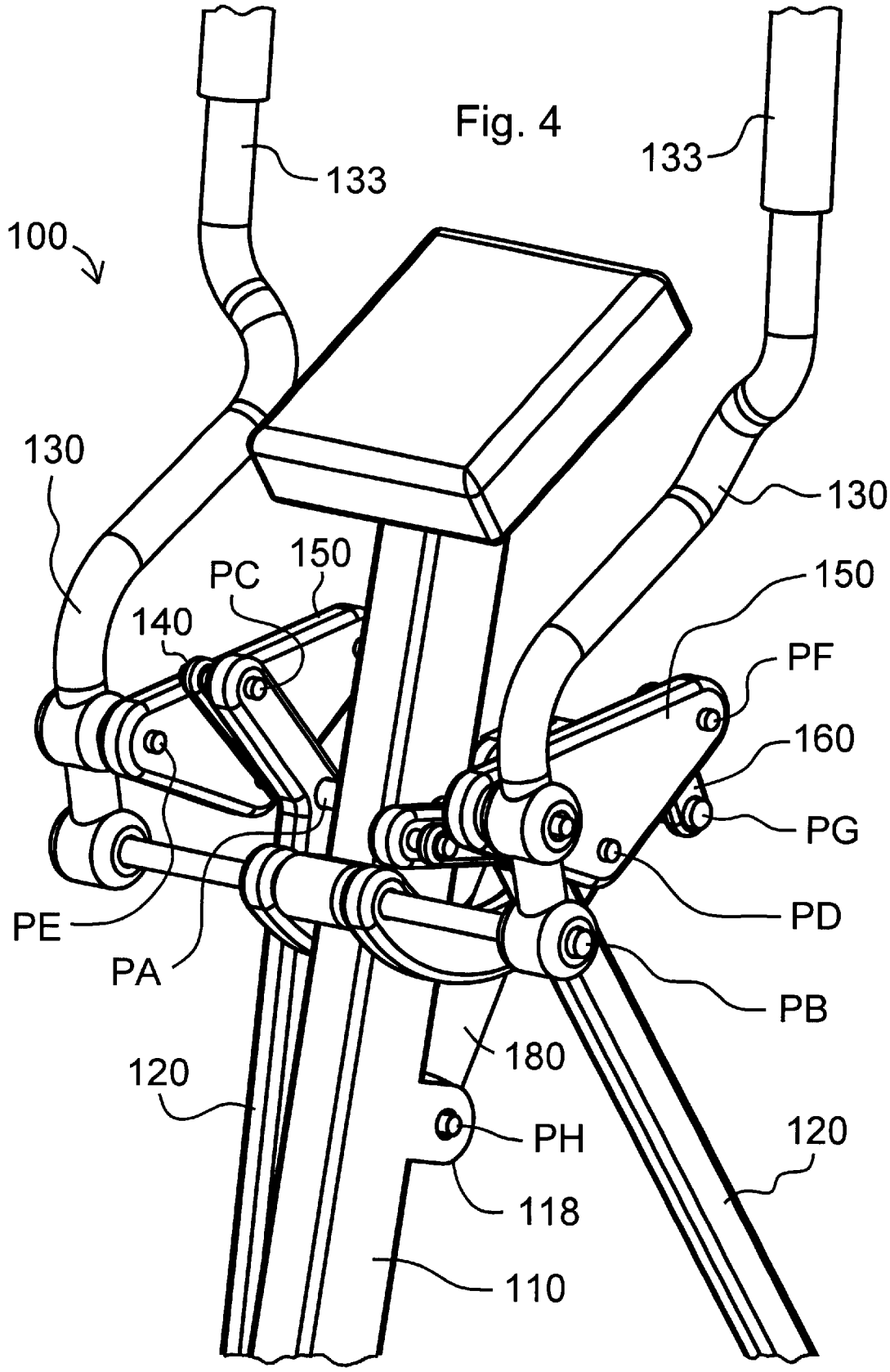
FIG. 4 is the same perspective view of the transmission assembly of FIG. 2, with the right leg driven member at a relatively forward position, and the handlebars available for movement through a relatively small range of motion.
Figure 5:
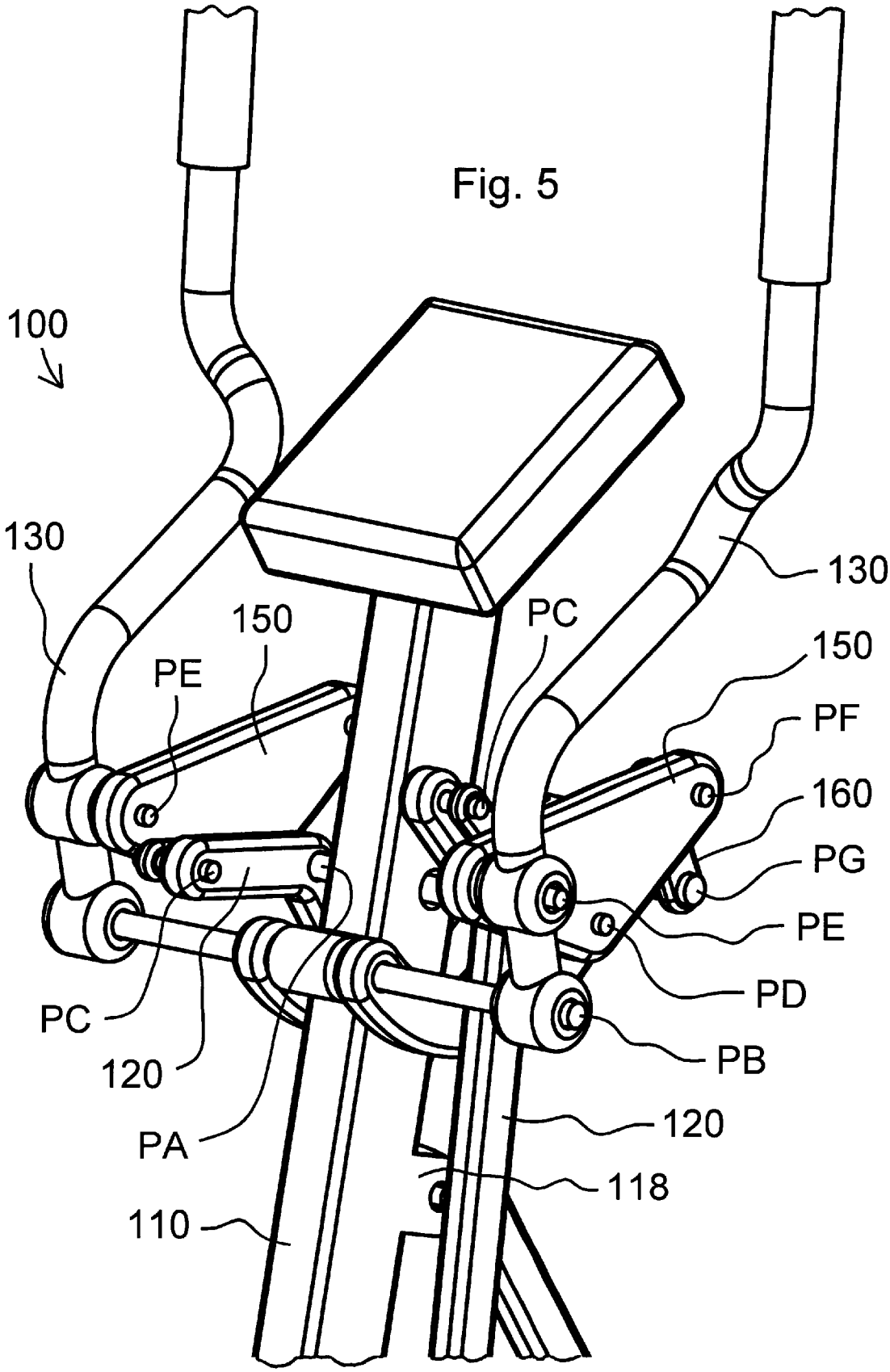
FIG. 5 is the same perspective view of the transmission assembly of FIG. 2, with the right leg driven member at a relatively rearward position, and the handlebars available for movement through a relatively small range of motion.
Figure 6:
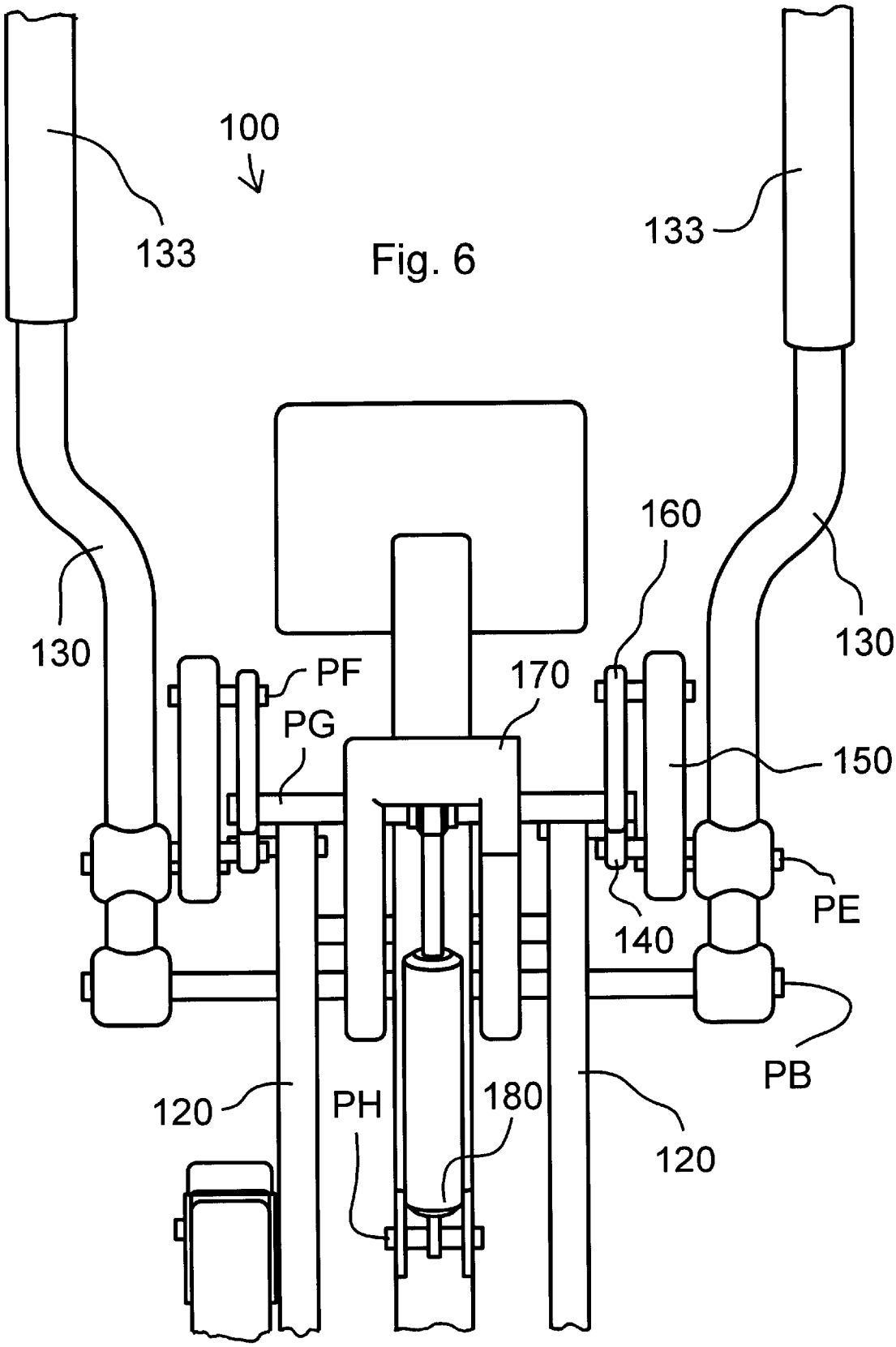
FIG. 6 is a front view of the transmission assembly of FIG. 1.

FIG. 8 shows the right and left foot supporting links 220 at respective forwardmost and rearwardmost positions and the corresponding positions of the left and right handles 133 when the transmission assembly 100 is set for relatively large displacement (FIGS. 2–3). FIG. 9 shows the right and left foot supporting links 220 at respective forwardmost and rearwardmost positions and the corresponding positions of the left and right handles 133 when the transmission assembly 100 is set for relatively small displacement (FIGS. 4–5). The operation of the leg exercising portion of the machine 200 is essentially identical in these two different situations, and no disruption of leg exercise is necessary in order to transition between the two situations.

A flywheel 280 is secured to the crank shaft and thereby constrained to rotate together with the cranks 240. The flywheel adds inertia to the linkage assembly, and various known resistance mechanisms may be connected to the flywheel (or directly to the cranks 240) to add resistance, as well (or in the alternative). For example, a drag strap 288 may be disposed about the circumference of the flywheel 280 and maintained in tension as shown in U.S. Pat. No. 4,023,795 (which is incorporated herein by reference). Other suitable resistance mechanisms include known electrical braking arrangements and other known types of mechanical braking arrangements. Those skilled in the art will also recognize that the flywheel 280 could be replaced by a relatively large diameter pulley which is linked to a remote, "stepped up" flywheel by means of a relatively small diameter pulley and a belt or chain.

A user interface or console 219 is mounted on top of the forward stanchion 110. The console 219 may be configured to perform a variety of functions, including (1) displaying information to the user, including (a) exercise parameters and/or programs, (b) the current parameters and/or currently selected program, (c) the current time, (d) the elapsed exercise time, (e) the current speed of exercise, (f) the average speed of exercise, (g) the number of calories burned during exercise, (h) the simulated distance traveled during exercise, (i) material transmitted over the internet, and/or (j) amounts of work currently being performed by the user's arms and/or legs; (2) allowing the user to (a) select or change the information being viewed, (b) select or change an exercise program, (c) adjust the resistance to exercise of the arms and/or the legs, (d) adjust the stroke length of the arms (and/or the legs on adjustable stride machines), (e) adjust the orientation of the exercise motion, and/or (f) quickly stop the exercise motion of the arms and/or the legs.

As noted above, in the absence of user applied force (or in response to an alternative outside influence), the transmission assembly 100 will move toward and/or tend to remain in the configuration shown in FIG. 9 (with the handles 133 movable through a minimum range of motion). In this mode of operation, all of the exercise work is being performed by the user's legs. By exerting force sufficient to overcome the bias force of the telescoping member 180 (and/or the weight of the associated links), the user can gradually move the assembly 100 toward the configuration shown in FIG. 8 (with the handles 133 movable through a maximum range of motion). As long as the user applies force against the handles 133 which is sufficient to resist the spring force of the telescoping member 180 (and the over center weight of the links), the machine will tend to remain in the FIG. 8 configuration. In this mode of operation, exercise work is being performed by both the user's arms and the user's legs, and the console 219 may be designed to display the effort (or relative effort) of each. In this regard, the present invention may be described in terms of providing synchronized arm exercise and leg exercise while separately facilitating, monitoring, and/or displaying the work associated with each.

If the user stops exerting such force and/or simply releases the handles 133, the transmission assembly 100 will gradually move toward the FIG. 9 configuration (subject to the dampening effect of the telescoping member 180). The console 219 may be designed to, among other things, alert the user if arm exercise falls below a target level. In any event, the user may also have the option of simply electing to "turn off" the arms to facilitate the performance of a secondary task, such as reading a book, browsing the internet, or taking a drink, or to focus only on lower body exercise, for example.

The present invention provides various methods which may be implemented in various ways and/or described with reference to various embodiments, including the foregoing embodiment. One such method is to provide arm and leg driven members which are synchronized but subject to independent ranges of motion. Another such method is to provide arm and leg driven members which are synchronized but subject to independent resistance. Yet another such method is to provide arm driven members which are secured to the frame whenever they are not moving in synchronization with respective leg driven members.

Figures 10, 11:
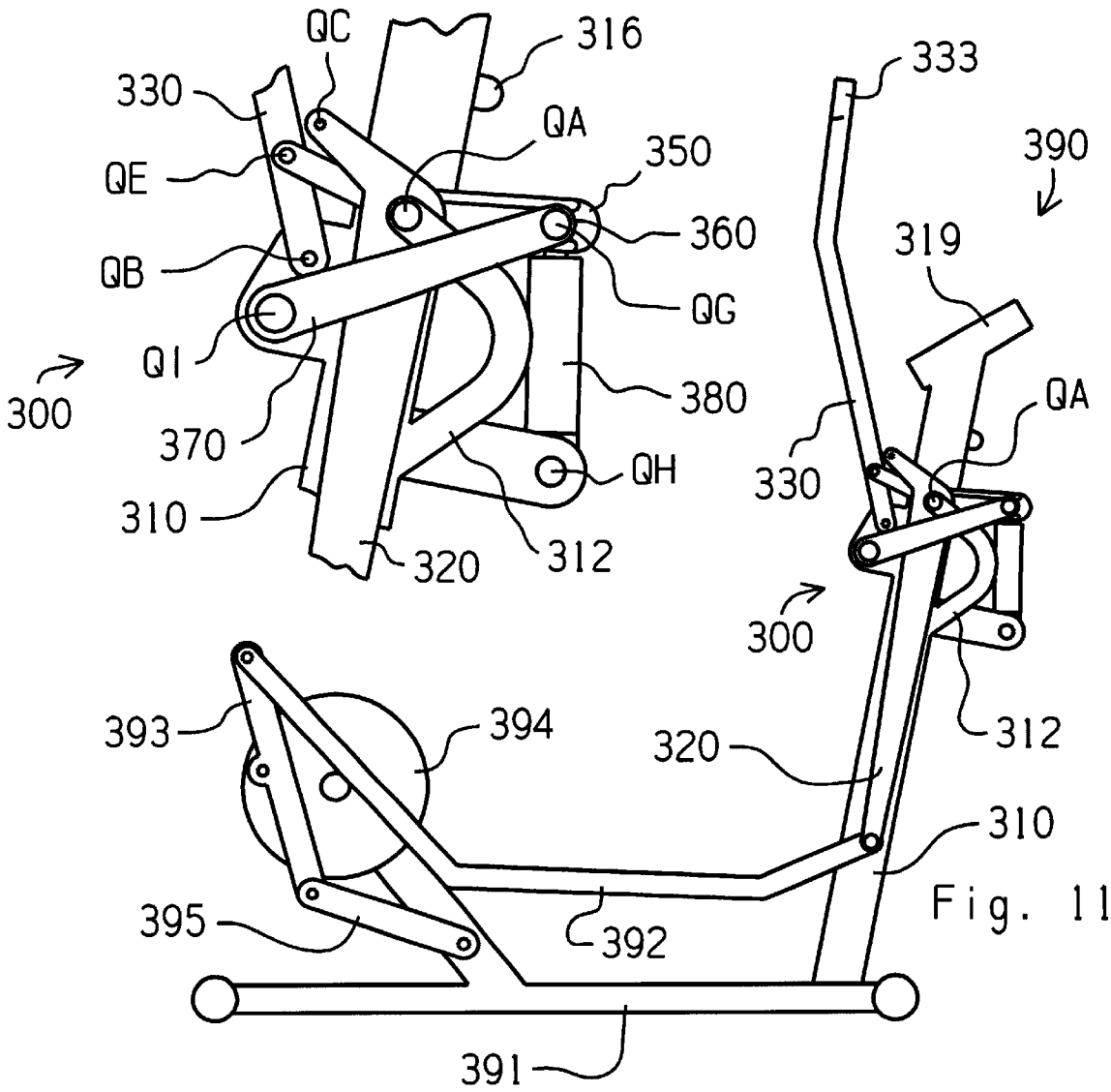
FIG 10 is a side view of another transmission assembly constructed according to the principles of the present invention, with the handlebars available for movement through a relatively small range of motion.
FIG. 11 is a side view of the transmission assembly of FIG. 10 installed on an elliptical exercise apparatus.
Figures 12, 13:
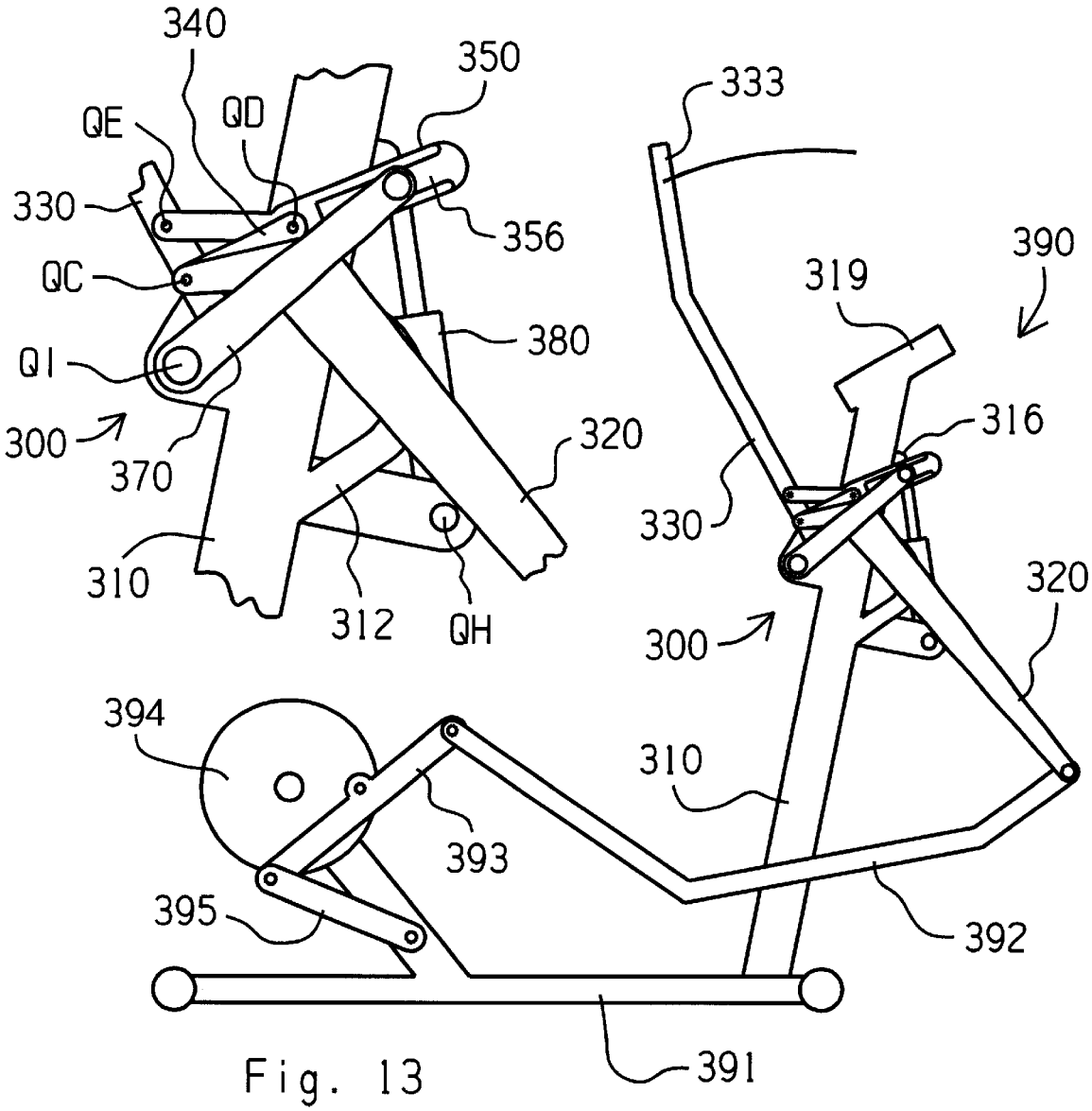
FIG. 12 is a side view of the transmission assembly of FIG. 10, with the handlebars available for movement through a relatively large range of motion.
FIG. 13 is a side view of the elliptical exercise apparatus of FIG. 11, with the transmission assembly configured as shown in FIG. 12.

Another embodiment of the present invention is designated as 300 in FIGS. 10–13 and shown on an elliptical exercise machine 390 in FIGS. 11 and 13. Generally speaking, the assembly 300 is like the assembly 100 but with sliding "directing" links 350 in place of pivoting "directing" links 150. FIGS. 10–11 show the assembly 300 configured for minimum displacement of the arm driven member 330, and FIGS. 12–13 show the assembly 300 configured for maximum displacement of the arm driven member 330.

Only one side of the assembly 300 and the machine 390 is shown for ease of illustration. The exercise apparatus 390 includes a frame 391 designed to rest upon a floor surface; left and right cranks 394 rotatably mounted on the frame 391; left and right connector links 393 having intermediate portions rotatably connected to respective cranks 394; left and right rocker links 395 pivotally connected between the frame 391 and lower ends of respective connector links 393; and left and right foot supporting links 392 pivotally interconnected between upper ends of respective connector links 393 and lower ends of respective leg driven members 320. Each of the foot supporting links 392 has an intermediate portion which is sized and configured to support a foot of a standing person, and constrained to move through an elliptical path as the cranks 394 rotate and the leg driven members 320 pivot back and forth.

On each side of the assembly 300, a leg driven member 320 is pivotally connected to the frame 391 at pivot axis QA. A dedicated support bracket 312 supports a respective leg driven member 320 at a relatively outboard location relative to the forward stanchion 310. As shown in FIG. 12, an upper end of the leg driven member 320 is pivotally connected to a first directing link 340 at pivot axis QC. An opposite end of the first directing link 340 is pivotally connected to an intermediate portion of a second directing link 350 at pivot axis QD. A first end of the second directing link 350 is pivotally connected to the arm driven member 330 at pivot axis QE. As shown in FIG. 10, a lower end of the arm driven member 330 is pivotally connected to the stanchion 310 at pivot axis QB. An opposite, second end of the second directing link 350 is provided with a race 356 which accommodates a roller 360. The roller 360 rotates about a roller axis QG relative to an end of a limiting link 370. An opposite end of the limiting link 370 is pivotally connected to the forward stanchion 310 at pivot axis QI.

A single roller shaft is rigidly secured between the left and right limiting links 370. An intermediate portion of the shaft engages a stop 316 on the forward stanchion 310 when the assembly 300 is configured as shown in FIG. 12. A single telescoping member 380 has a rod end pivotally connected to an intermediate portion of the roller shaft at pivot axis QG, and an opposite, cylinder end pivotally connected to the forward stanchion 310 at pivot axis QH. The telescoping member 380 includes both a spring and a damper, and is similar to the telescoping member 180.

The assembly 300 operates in a manner similar to the assembly 100, except that the directing links 350 slide back and forth relative to the rollers 360 during arm exercise motion. The pivot axis QD is moved away from the pivot axis QA to increase the range of the handles 333 on the arm driven members 330 (as in FIGS. 12–13), and the pivot axis QD is moved toward the pivot axis QA to decrease the range of the handles 333 (as in FIGS. 10–11). The spring in the telescoping member 380 biases the assembly 300 toward the latter configuration, but may be overcome by user force applied against the handles 333. A user interface 319 is mounted on top of the forward stanchion 310 and functions in a manner similar to the user interface 219.

Figures 14, 15:
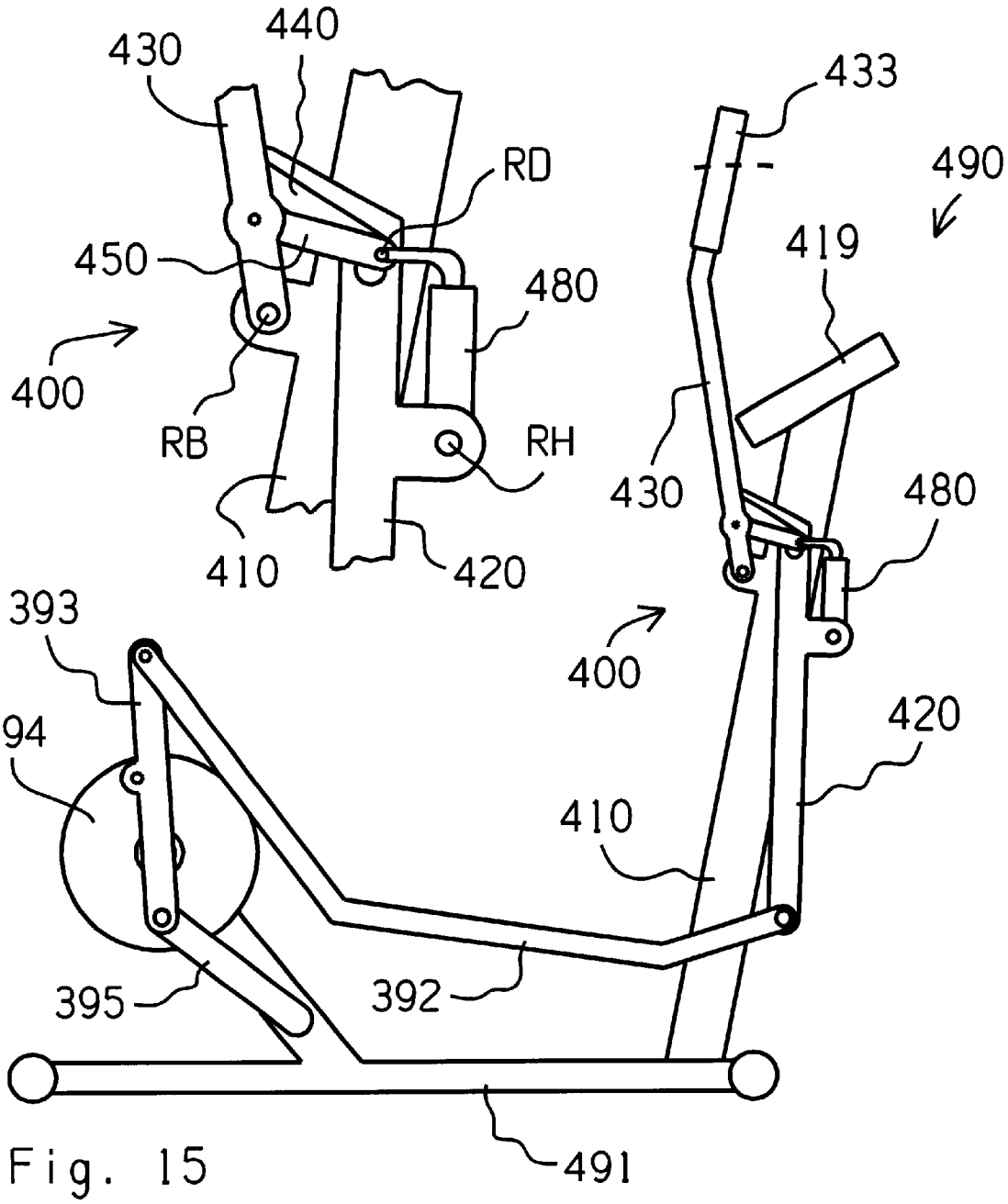
FIG. 14 is a side view of another transmission assembly constructed according to the principles of the present invention, with the handlebars available for movement through a relatively small range of motion.
FIG. 15 is a side view of the transmission assembly of FIG. 14 installed on an elliptical exercise apparatus.

Other, related embodiments of the present invention are shown in FIGS. 14–19. Generally speaking, the assemblies 400, 400', and 400" are like the assembly 100, but with a separate handle adjustment mechanism on each side and thus, no common, limiting link assembly. In other words, these assemblies may be designed to allow and/or require the user to independently adjust and/or operate each handle. The only distinction between the assemblies 400, 400', and 400" is the manner in which adjustments are made to the arm exercise stroke. FIGS. 14–15 show the assembly 400 configured for minimum displacement of the arm driven member 430, and FIGS. 16–19 show the assemblies 400' and 400" configured for maximum displacement of the arm driven member 430 or 430'. Only one side of each assembly and the machine is shown for ease of illustration. The exercise apparatus 490 includes a frame 491 designed to rest upon a floor surface, and the same cranks 394, connector links 393, rocker links 395, and foot supporting links 392 movably interconnected between the frame 491 and the leg driven members 420.

Figures 16, 17:
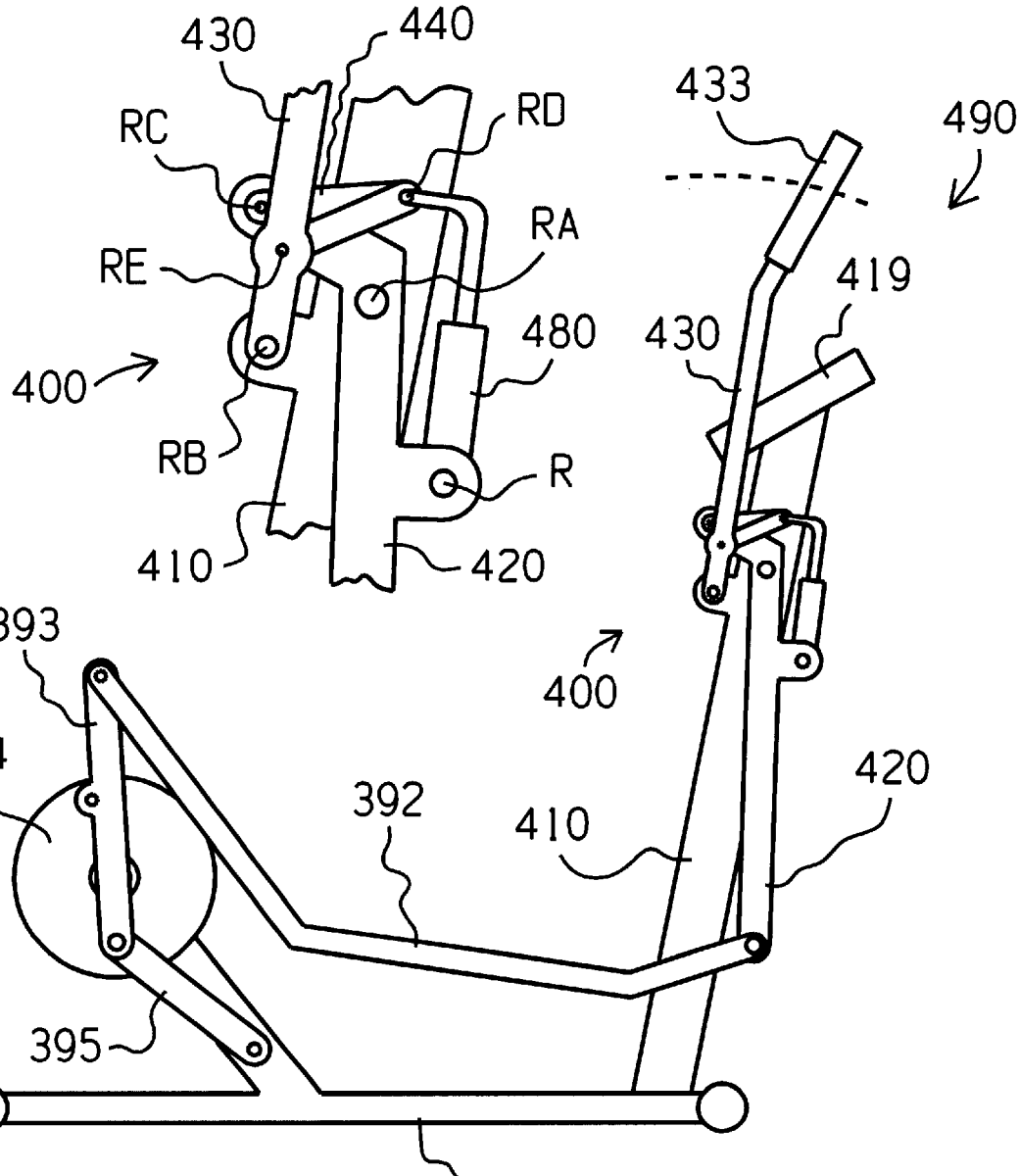
FIG. 16 is a side view of a transmission assembly like the transmission assembly of FIG. 14, but with a different adjustment mechanism, and with the handlebars available for movement through a relatively large range of motion.
FIG. 17 is a side view of the transmission assembly of FIG. 16 installed on an elliptical exercise apparatus.

On each side of the assemblies 400, 400' and 400", a leg driven member 420 is pivotally connected to the frame 491 at pivot axis RA. As shown in FIG. 16, an upper end of the leg driven member 420 is pivotally connected to a first directing link 440 at pivot axis RC. An opposite end of the first directing link 440 is pivotally connected to a second directing link 450 at pivot axis RD. An opposite end of the second directing link 450 is pivotally connected to the arm driven member 430 at pivot axis RE. As shown in FIG. 14, a lower end of the arm driven member 430 is pivotally connected to the stanchion 410 at pivot axis RB.

On the assembly 400, a telescoping member 480 has a rod end pivotally connected to the pivot axis RD, and an opposite, cylinder end pivotally connected to the leg driven member 420 at pivot axis RH. The telescoping member 480 includes both a spring and a damper, and is like the telescoping member 180. On the assembly 400', a telescoping member 482 similarly has a rod end pivotally connected to the pivot axis RD, and an opposite, cylinder end pivotally connected to the leg driven member 420 at pivot axis RH. The telescoping member 482 is incrementally adjusted by inserting a pin 408 through a hole in the cylinder and one of several holes in the rod. The holes in the rod preferably accommodate both a stationary handle mode and at least two different ranges of handle motion. On the assembly 400", torsional springs and dampers (such as rubber discs) 483 are interconnected between respective arm driven members 430' and directing links 450 at respective pivot axes RE. The members 483 are installed in a manner which biases respective pivot axes RD toward the pivot axis RA.

The assemblies operate in a manner similar to the assembly 100, except that each side of the assembly is independently adjustable. The pivot axis RD is moved away from the pivot axis RA to increase the range of the handle 433 on a respective arm driven member 430 (as in FIGS. 16–19), and the pivot axis RD is moved toward the pivot axis RA to decrease the range of a respective handle 433 (as in FIGS. 14–15). The assemblies 400 and 400' are biased toward the latter configuration, but the bias force may be overcome by user force applied against the handle 433. A user interface 419 is mounted on top of the forward stanchion 410 and functions in a manner similar to the user interface 219.

Figures 22, 23:
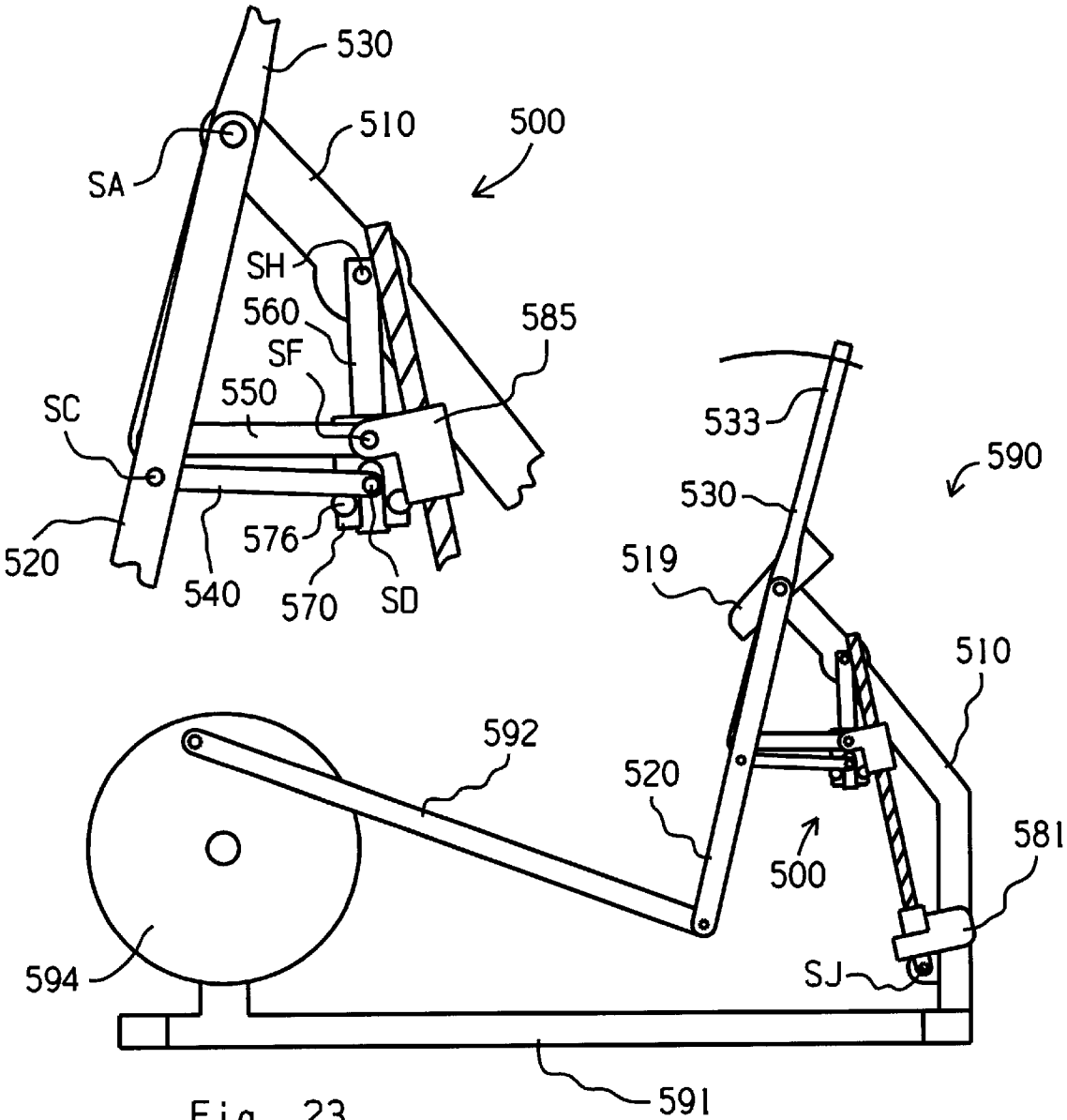
FIG. 22 is a side view of the transmission assembly of FIG. 20, with the handlebars available for movement through a relatively large range of motion.
FIG. 23 is a side view of the elliptical exercise apparatus of FIG. 21, with the transmission assembly configured as shown in FIG. 22.

Another embodiment of the present invention is designated as 500 in FIGS. 20–23 and shown on an elliptical exercise machine 590 in FIGS. 21 and 23. Generally speaking, the assembly 500 uses intermediate rocker links 560 to link pivoting of respective leg driven members 520 to pivoting of respective arm driven members 530. FIGS. 20–21 show the assembly 500 configured for minimum displacement of the arm driven member 530, and FIGS. 22–23 show the assembly 500 configured for maximum displacement of the arm driven member 530.

Only one side of the assembly 500 and the machine 590 is shown for ease of illustration. The exercise apparatus 590 includes a frame 591 designed to rest upon a floor surface;

left and right cranks 594 rotatably mounted on the frame 591; and left and right foot supporting links 592 pivotally interconnected between respective cranks 594 and lower ends of respective leg driven members 520. Each of the foot supporting links 592 has an intermediate portion which is sized and configured to support a foot of a standing person, and constrained to move through an elliptical path as the cranks 594 rotate and the leg driven members 520 pivot.

On each side of the assembly 500, a leg driven member 520 is pivotally connected to the frame 591 at pivot axis SA. A discrete portion of the leg driven member 520 (beneath the pivot axis SA) is pivotally connected to a first connector link 540 at pivot axis SC. An opposite end of the first connector link 540 is pivotally connected to a distal end of the intermediate rocker link 560 at pivot axis SD. An opposite end of the intermediate rocker link 560 is pivotally connected to the stanchion 510 at pivot axis SH. The arm driven member 530 is pivotally connected to the stanchion 510 at the same pivot axis SA. A discrete portion of the arm driven member 530 (beneath the pivot axis SA) is pivotally connected to a second connector link 550 at pivot axis SE. An opposite end of the second connector link 550 is pivotally connected to an intermediate portion of the intermediate rocker link 560 at pivot axis SF.

The pivot axis SF is carried or supported by a slide member 570 which is movably mounted on the intermediate rocker link 560 by means of rollers 576. As the pivot axis SF approaches the pivot axis SH (see FIGS. 20–21), the angular displacement of the arm driven member 530 approaches zero, because the pivot axis SF moves through a relatively small arc. On the other hand, as the pivot axis SF approaches the pivot axis SD (see FIGS. 22–23), the angular displacement of the arm driven member 530 approaches one to one correspondence with the angular displacement of the leg driven member 520, because the pivot axes SF and SD move through comparable arcuate paths.

A coupling member 585 is pivotally connected to the slide member 570 at pivot axis SF. The coupling member 585 is also threadably mounted on an upper portion of a lead screw 583. An opposite, lower end of the lead screw 583 is operatively connected to a motor 581 which is pivotally connected to the frame 591 at pivot axis SJ. In response to a control signal from the user interface 519, the motor 581 turns the lead screw 583 to relocate the coupling member 585 along the lead screw 583 and thereby adjust the slide member 570 (and the pivot axis SF) along the intermediate rocker link 560. In addition and/or in the alternative, the pivot axis SD may be similarly adjusted relative to the pivot axis SH, and/or the pivot axes SC and/or SE may be similarly adjusted relative to the pivot axis SA.

Figures 24, 25:
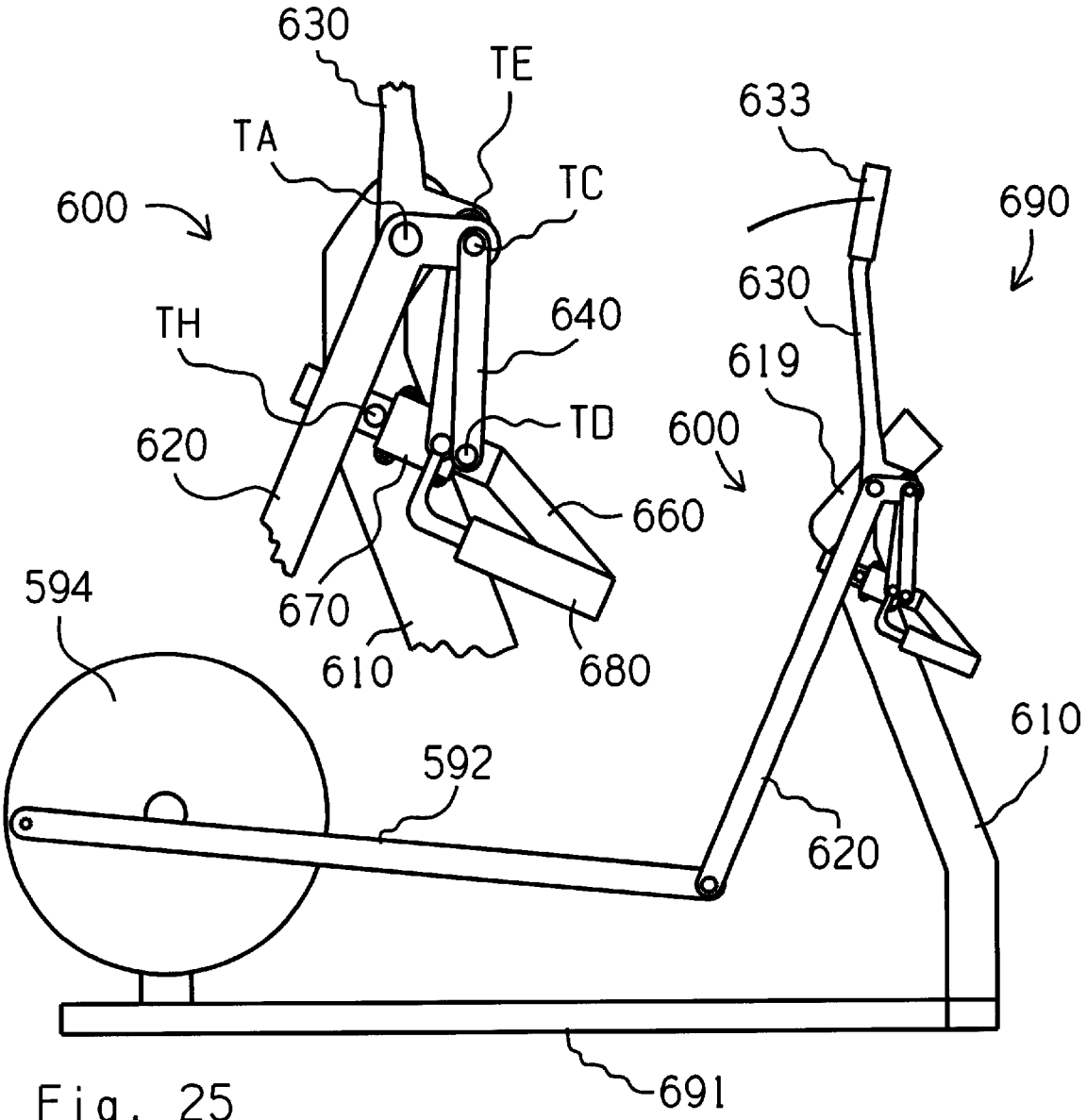
FIG. 24 is a side view of another transmission assembly constructed according to the principles of the present invention, with the handlebars available for movement through a relatively large range of motion.
FIG. 25 is a side view of the transmission assembly of FIG. 24 installed on an elliptical exercise apparatus.

Another embodiment of the present invention is designated as 600 in FIGS. 24–25 and 27 and shown on an elliptical exercise machine 690 in FIGS. 25 and 27. Generally speaking, the assembly 600 uses an intermediate rocker link arrangement which is similar in certain respects to that on the previous embodiment 500. FIGS. **26*a*–26*b* and 27 show the assembly 600 configured for minimum displacement of the arm driven member 630, and FIGS. 24–25 and 26*c* show the assembly 600 configured for maximum displacement of the arm driven member 630**.

Only one side of the assembly 600 and the machine 690 is shown for ease of illustration. The exercise apparatus 690 includes a frame 691 designed to rest upon a floor surface; left and right cranks 594 rotatably mounted on the frame 691; and left and right foot supporting links 592 rotatably interconnected between respective cranks 594 and lower ends of respective leg driven members 620. Each of the foot supporting links 592 has an intermediate portion which is sized and configured to support a foot of a standing person, and constrained to move through an elliptical path as the cranks 594 rotate and the leg driven members 620 pivot.

On each side of the assembly 600, a leg driven member 620 is pivotally connected to the frame 691 at pivot axis TA. An upper distal end of the leg driven member 620 is pivotally connected to a first connector link 640 at pivot axis TC. An opposite end of the first connector link 640 is pivotally connected to an intermediate portion of an intermediate rocker link 660 at pivot axis TD. A first end of the intermediate rocker link 660 is pivotally connected to the stanchion 610 at pivot axis TH. The arm driven member 630 is pivotally connected to the stanchion 610 at the same pivot axis TA (as a matter of manufacturing efficiency rather than operational necessity). A lower distal end of the arm driven member 630 is pivotally connected to a second connector link 650 at pivot axis TE. An opposite end of the second connector link 650 is pivotally connected to an intermediate portion of the intermediate rocker link 660 at pivot axis TF.

The pivot axis TF is carried or supported by a slide member 670 which is movably mounted on the intermediate rocker link 660 by means of rollers 676. As the pivot axis TF approaches the pivot axis TH (see FIGS. **26*a*–26*b* and 27), the angular displacement of the arm driven member 630 approaches zero, because the pivot axis TF moves through a relatively small arc. On the other hand, as the pivot axis TF approaches the pivot axis TD (see FIGS. 24–25 and 26*c*), the angular displacement of the arm driven member 630 approaches one to one correspondence with the angular displacement of the leg driven member 620**, because the pivot axes TF and TD move through comparable arcuate paths.

A telescoping member 680 has a rod end connected to the slide member 670 at pivot axis TF, and an opposite, cylinder end connected to an opposite end of the intermediate rocker link 660. On this embodiment 690, the telescoping member 680 is a linear actuator which is operatively connected to a user interface 619 mounted on top of the stanchion 610. In response to a control signal from the user interface 619, the actuator 680 extends or contracts to adjust the slide member 670 (and the pivot axis TF) along the intermediate rocker link 660. As noted with respect to the previous embodiment 500, other pivot axes (TC, TD, TE) may be similarly adjusted in addition and/or in the alternative.

Figure 28:
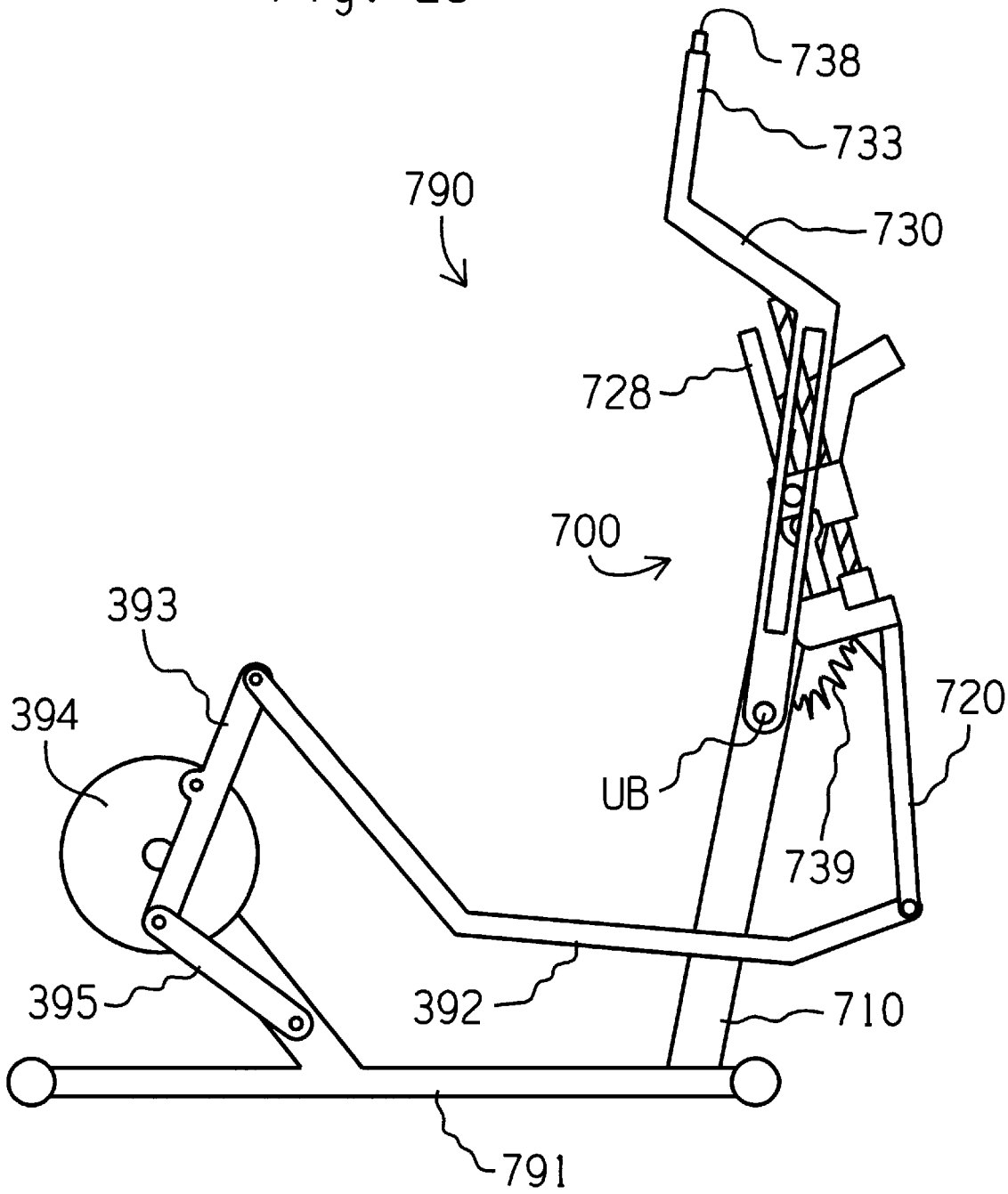
FIG. 28 is a side view of another transmission assembly constructed according to the principles of the present invention, installed on an elliptical exercise apparatus, and configured so the handlebars are available for movement through a relatively small range of motion.
Figure 29:
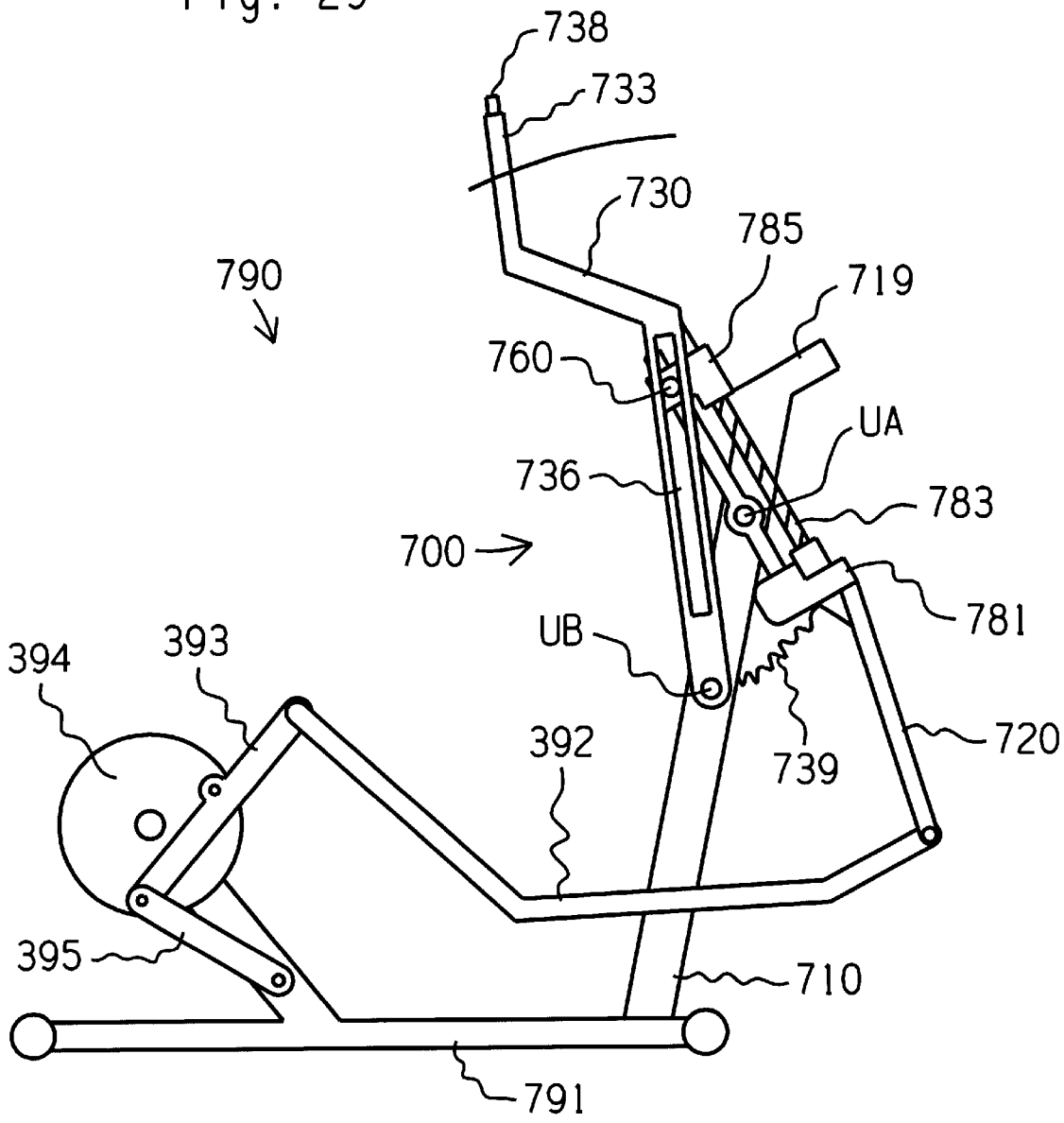
FIG. 29 is a side view of the transmission assembly and elliptical exercise apparatus of FIG. 28, but configured so the handlebars are available for movement through a relatively large range of motion.

Another embodiment of the present invention is designated as 700 and shown on an elliptical exercise machine 790 in FIGS. 28–29. Generally speaking, the assembly 700 is similar to the assembly 400, but with the leg driven members 720 and the arm driven members 730 interconnected by respective slide assemblies rather than pivotally interconnected links 440 and 450. FIG. 28 shows the assembly 700 configured for minimum displacement of the arm driven member 730, and FIG. 29 shows the assembly 700 configured for maximum displacement of the arm driven member 730.

Only one side of the assembly 700 and the machine 790 is shown for ease of illustration. The exercise apparatus 790 includes a frame 791 designed to rest upon a floor surface, and the same cranks 394, connector links 393, rocker links 395, and foot supporting links 392 movably interconnected between the frame 791 and the leg driven members 720.

On each side of the assembly 700, a leg driven member 720 is pivotally connected to the frame 791 at pivot axis UA. A coupling member 785 is slidably mounted on an upper distal portion 728 of the leg driven member 720. The coupling member 785 is also threadably mounted on an upper distal portion of a lead screw 783. An opposite, lower end of the lead screw 783 is operatively connected to a motor 781 which is rigidly mounted on the leg driven member 720. In response to a control signal from a button 738 (or a force sensor 737) on a handle 733, the motor 781 turns the lead screw 783 to relocate the coupling member 785 along both the lead screw 783 and the upper distal portion 728 of the leg driven member 720. The button 738 on the left handle 733 preferably signals each motor 781 to turn a respective lead screw 783 in a first direction, and the button 738 on the right handle 733 preferably signals each motor 781 to turn a respective lead screw 783 in a second, opposite direction. The buttons 738 are connected to a common controller (preferably disposed inside the user interface 719) which in turn is connected to each of the motors 781 via respective wires 739, for example.

On each side of the assembly 700, an arm driven member 730 is pivotally connected to the frame/91 at pivot axis UB. A race or slot 736 is provided in an intermediate portion of the arm member 730 to accommodate a peg 760 which extends from the coupling member 785. The peg 760 links pivoting of the leg driven member 720 to pivoting of the aim driven member 730. As the peg 760 is adjusted toward the pivot axis UA (see FIG. 28), the angular displacement of the arm driven member 730 approaches zero, because the peg 760 moves through a relatively small arc. On the other hand, as the peg 760 is adjusted away from the pivot axis UA (see FIG. 29), the angular displacement of the arm driven member 730 increases, CM because the peg 760 moves through a relatively larger arc. It is to be understood that the term, "peg" may mean a simple peg and/or a roller rotatably mounted on a peg (to provide a rolling interface rather than a sliding interface).

Figure 44:
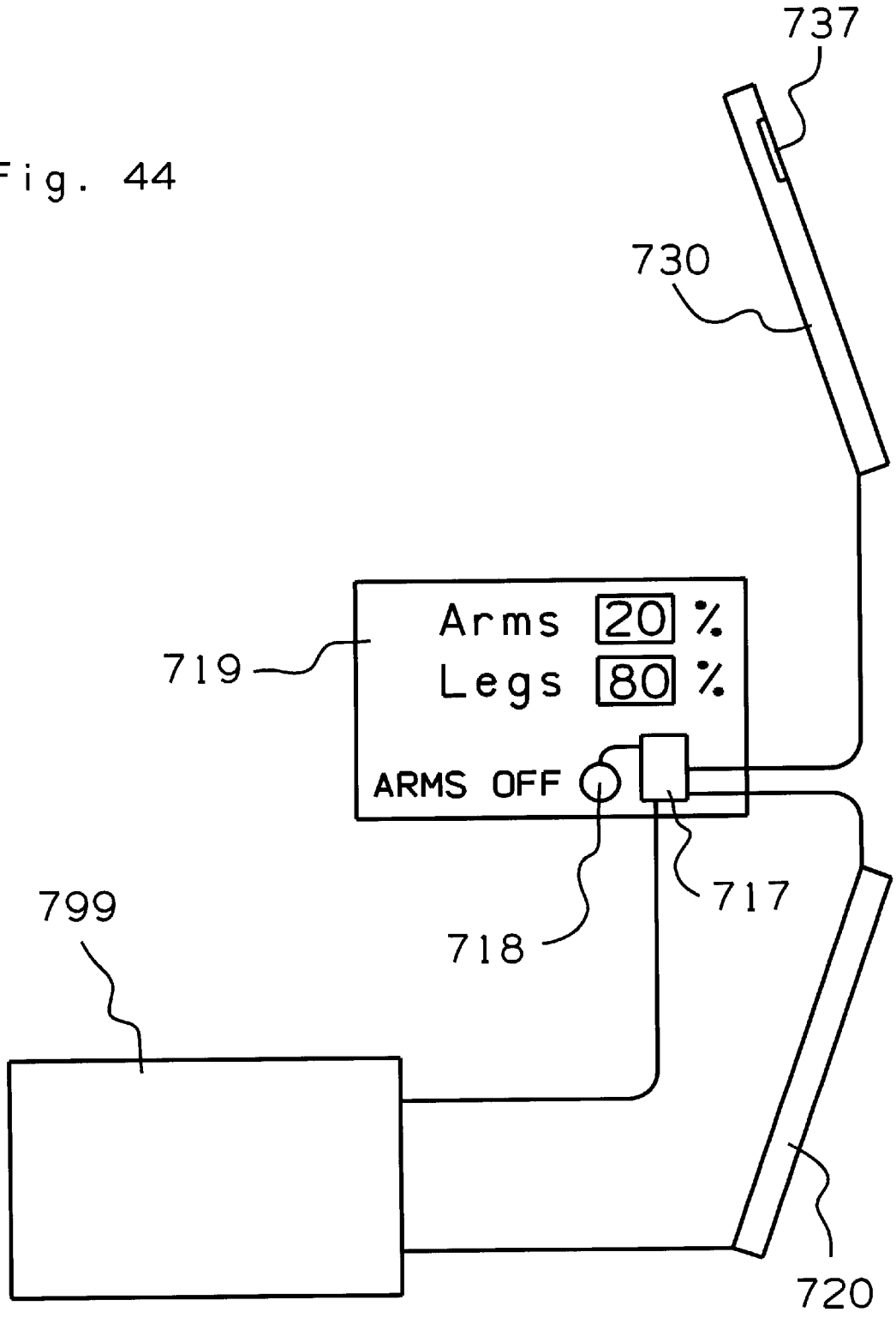
FIG. 44 is a schematic diagram of a control system suitable for use on several of the transmission assemblies and elliptical exercise machines shown in the foregoing Figures.

Generally speaking, on embodiments having linear actuators or other powered mechanisms for adjusting the range of arm exercise motion, independent arm resistance may be provided by monitoring forces associated with arm exercise and adjusting the resistance to leg exercise accordingly. As shown in FIG. 44, for example, force sensors 737 may be placed on the arm driven members 730 and connected to a controller 717 (preferably inside the user interface 719). The controller 717 is also connected to a resistance device 799 (such as an electromagnetic brake) associated with the leg driven members 720 (via the cranks 394, for example). For a given leg exercise resistance setting, the controller 717 may be programmed to increase the resistance force of the device 799 in an amount equal to any increase in user force exerted against the arm driven members 730 and to subsequently decrease the resistance force of the device 799 in an amount equal to any decrease in user exerted force against the arm driven members 730.

On machines using either powered adjustment mechanisms or spring-biased adjustment mechanisms to adjust the range of arm exercise motion, the user interface 719 may be designed to show the amount (or relative amount) of work performed by the user's arms and the user's legs (instantaneously and/or during the course of a workout). Both types of machines may be designed to move the arm driven members to a particular position (a forwardmost position, for example) when released by a user. The machines with powered adjustment mechanisms may also be designed to rapidly adjust the range of arm exercise motion in response to sensing the presence or absence of a user's hands on the handles and/or at the push of a button 718 (preferably on the user interface 719), rather than in response to user exerted force.

Figure 30:
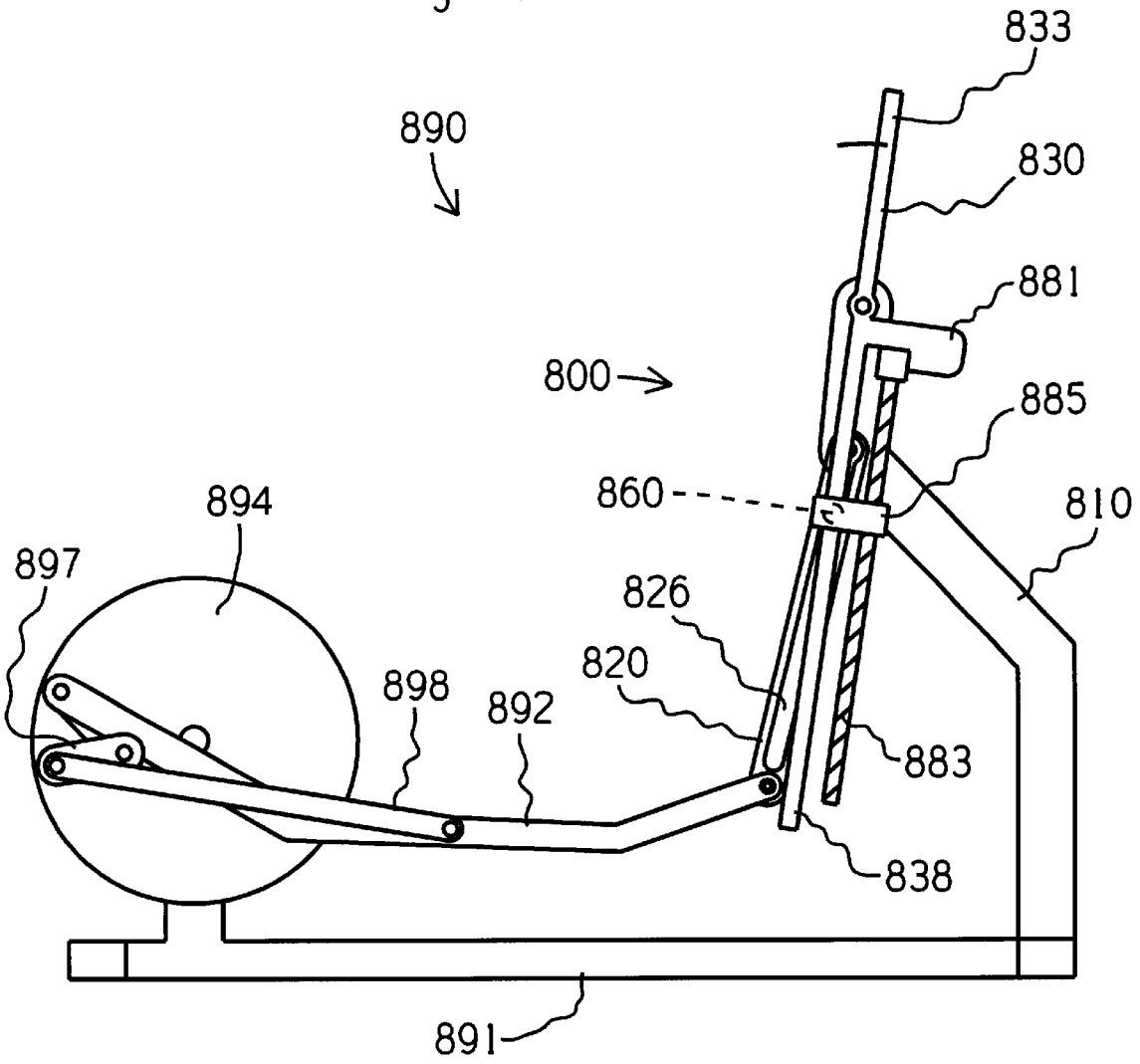
FIG. 30 is a side view of another transmission assembly constructed according to the principles of the present invention, installed on an elliptical exercise apparatus, and configured so the handlebars are available for movement through a relatively small range of motion.
Figure 31:
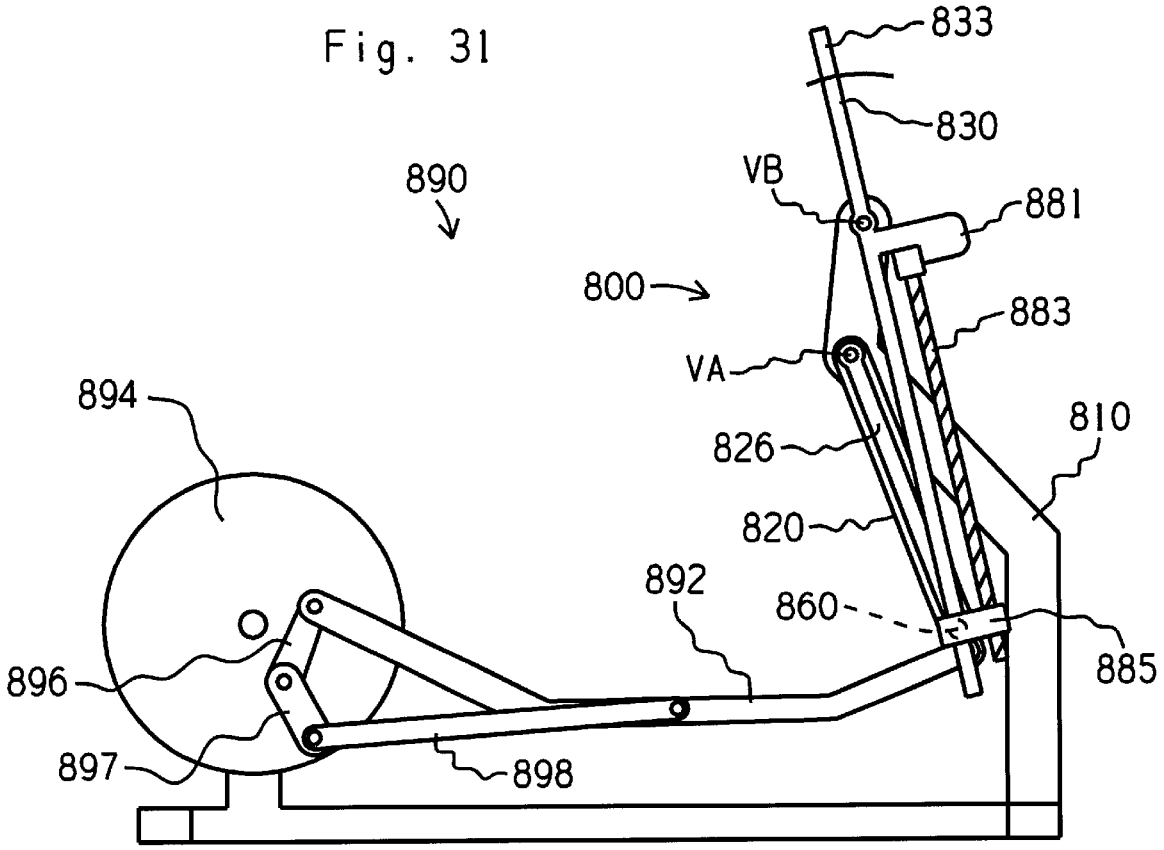
FIG. 31 is a side view of the transmission assembly and elliptical exercise apparatus of FIG. 30, but configured so the handlebars are available for movement through a relatively large range of motion.

Another embodiment of the present invention is designated as 800 and shown on an elliptical exercise machine 890 in FIGS. 30–31. Generally speaking, the assembly 800 is similar to the assembly 700, but with the locations of the races and the actuators switched. FIG. 30 shows the assembly 800 configured for minimum displacement of the arm driven member 830, and FIG. 31 shows the assembly 800 configured for maximum displacement of the arm driven member 830.

Only one side of the assembly 800 and the machine 890 is shown for ease of illustration. The exercise apparatus 890 includes a frame 891 designed to rest upon a floor surface; left and right cranks 894 rotatably mounted on the frame; left and right floating cranks 896 pivotally mounted on respective cranks 894; left and right foot supporting links 892 rotatably interconnected between respective floating cranks 896 and lower ends of respective leg driven members 820; left and right crank extensions 897 rigidly connected to respective cranks 894; and left and right drawbars 898 rotatably interconnected between respective crank extensions 897 and respective foot supporting links 892. Each of the foot supporting links 892 has an intermediate portion which is sized and configured to support a foot of a standing person, and constrained to move through an elliptical path as the cranks 894 rotate and the leg driven members 820 pivot back and forth.

On each side of the assembly 800, the leg driven member 820 is pivotally connected to the frame 891 at pivot axis VA. A race or slot 826 is provided in a lower portion of the leg member 820 to accommodate a peg 860 which extends from a coupling member 885. The peg 860 links pivoting of the leg driven member 820 to pivoting of the arm driven member 830. As the peg 860 is adjusted toward the pivot axis VA (see FIG. 30), the angular displacement of the arm driven member 830 approaches zero, because the peg 860 moves through a relatively small arc. On the other hand, as the peg 860 is adjusted, away from the pivot axis VA (see FIG. 31), the angular displacement of the arm driven member 830 increases, because the peg 860 moves through a relatively larger arc.

The arm driven member 830 is pivotally connected to the frame 891 at pivot axis VB. The coupling member 885 is slidably mounted on a lower distal portion 838 of the arm driven member 820. The coupling member 885 is also threadably mounted on a lower distal portion of a lead screw 883. An opposite, upper end of the lead screw 883 is operatively connected to a motor 881 which is rigidly mounted on the arm driven member 830. In response to a control signal (from a controller or a button on handle 833, for example), the motor 881 turns the lead screw 883 to relocate the coupling member 885 along both the lead screw 883 and the upper distal portion 838 of the arm driven member 830.

Figure 32:
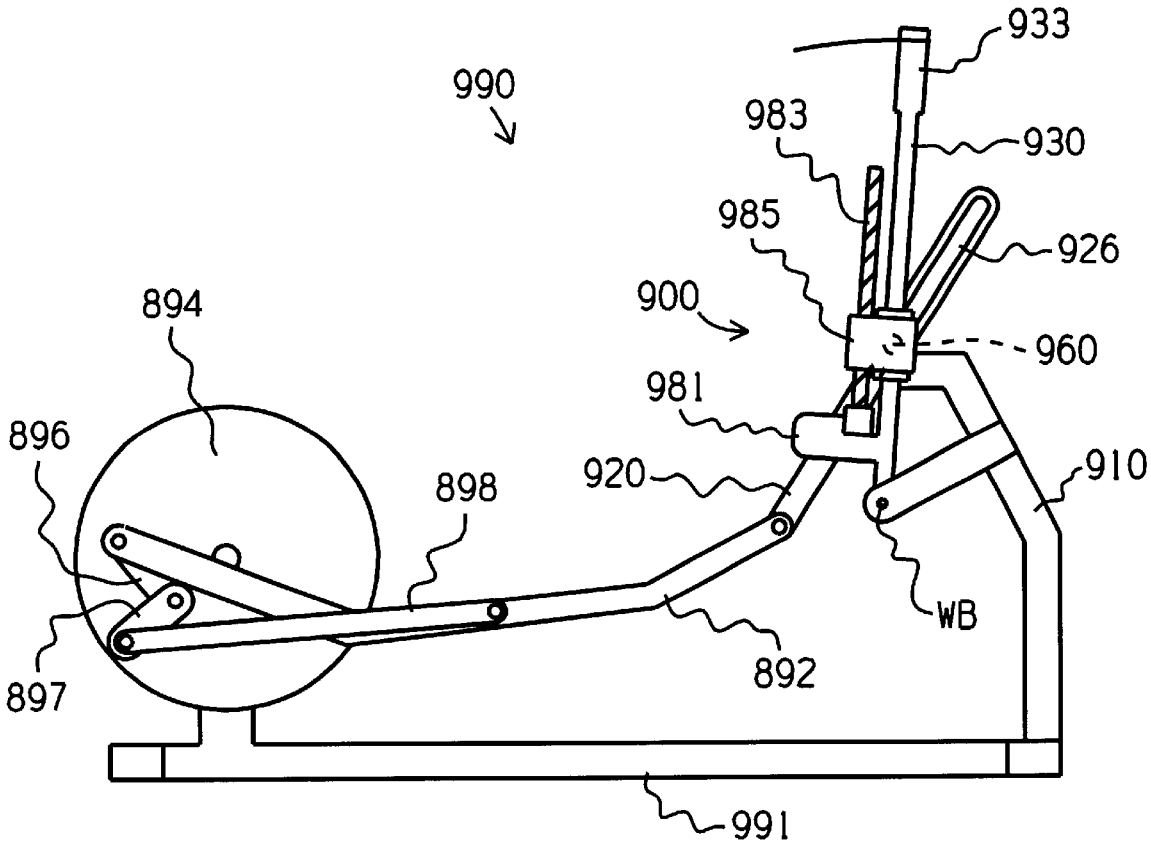
FIG. 32 is a side view of another transmission assembly constructed according to the principles of the present invention, installed on an elliptical exercise apparatus, and configured so the handlebars are available for movement through a relatively small range of motion.
Figure 33:
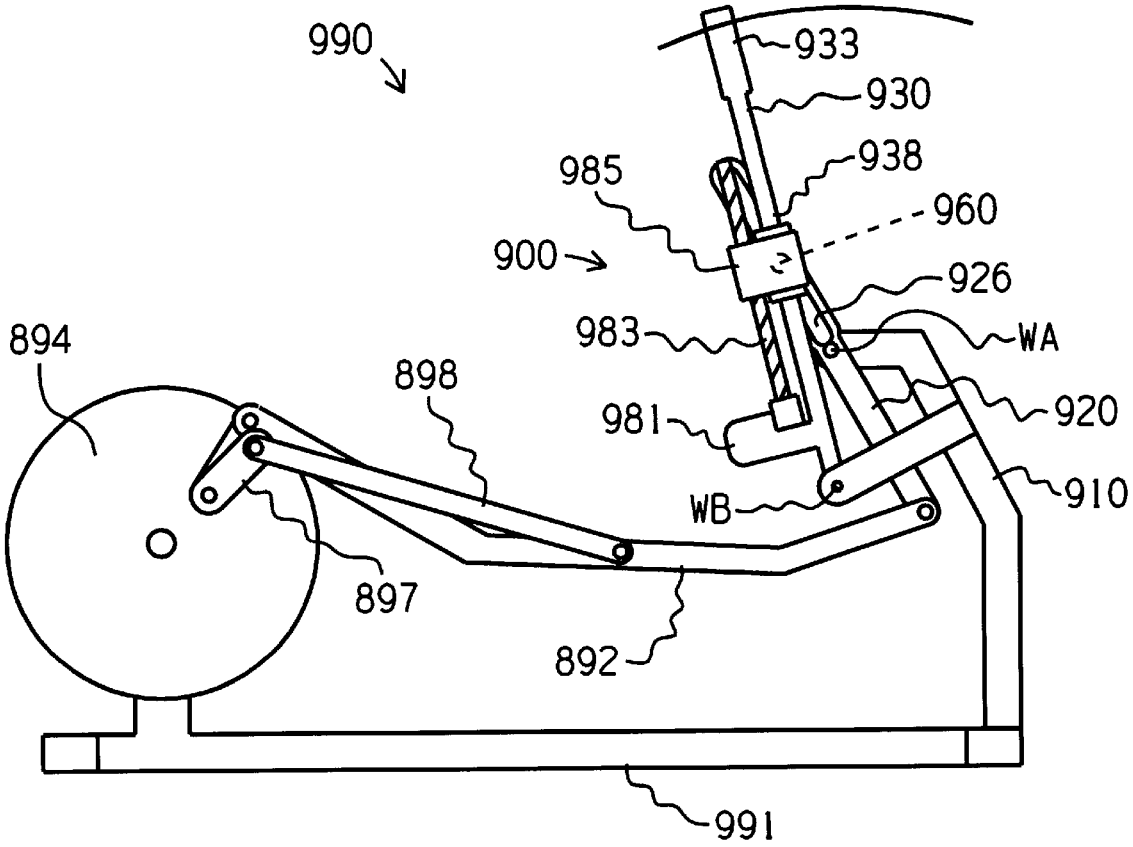
FIG. 33 is a side view of the transmission assembly and elliptical exercise apparatus of FIG. 32, but configured so the handlebars are available for movement through a relatively large range of motion.

Another embodiment of the present invention is designated as 900 and shown on an elliptical exercise machine 990 in FIGS. 32–33. Generally speaking, the assembly 900 is similar to the assembly 800, but with the pivot axis WA for the leg driven members 920 disposed above the pivot axis WB for the arm driven members 930. FIG. 32 shows the assembly 900 configured for minimum displacement of the arm driven member 930, and FIG. 33 shows the assembly 900 configured for maximum displacement of the arm driven member 930. Only one side of the assembly 900 and the machine 990 is shown for ease of illustration. The exercise apparatus 990 includes a frame 991 designed to rest upon a floor surface, and the same cranks 894, floating cranks 896, foot supporting links 892, crank extensions 897, and drawbar links 898.

On each side of the assembly 900, the leg driven member 920 is pivotally connected to the frame 991 at pivot axis WA. A race or slot 926 is provided in an upper portion of the leg member 920 to accommodate a peg 960 which extends from a coupling member 985. The peg 960 links pivoting of the leg driven member 920 to pivoting of the arm driven member 930. As the peg 960 is adjusted toward the pivot axis WA (see FIG. 32), the angular displacement of the arm driven member 930 approaches zero, because the peg 960 moves through a relatively small arc. On the other hand, as the peg 960 is adjusted away from the pivot axis WA (see FIG. 33), the angular displacement of the arm driven member 930 increases, because the peg 960 moves through a relatively larger arc.

The arm driven member 930 is pivotally connected to the frame 991 at pivot axis WB. The coupling member 985 is slidably mounted on an intermediate portion 938 of the arm driven member 920. The coupling member 985 is also threadably mounted on an upper distal portion of a lead screw 983. An opposite, lower end of the lead screw 983 is operatively connected to a motor 981 which is rigidly mounted on the arm driven member 930. In response to a control signal (from a controller or a button on handle 933), the motor 981 turns the lead screw 983 to relocate the coupling member 985 along both the lead screw 983 and the arm driven member 930.

Figure 34:
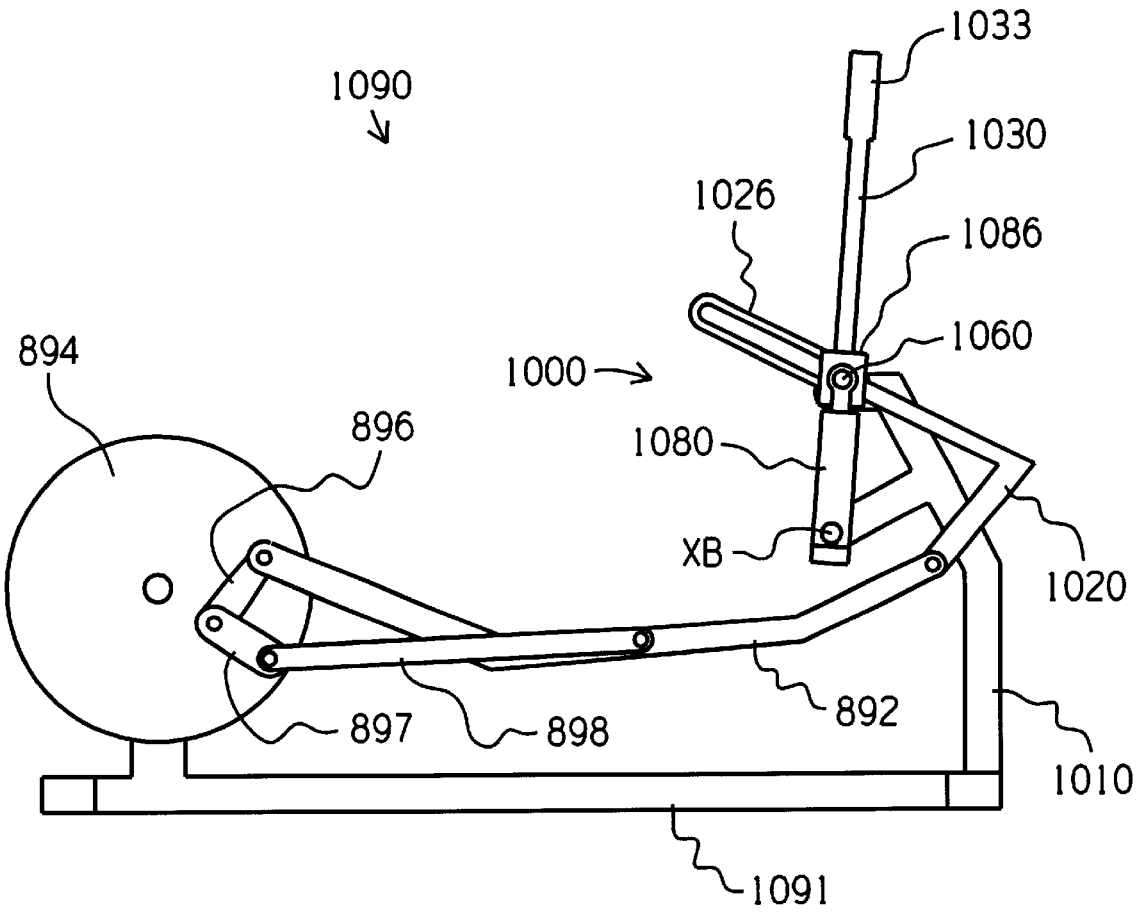
FIG. 34 is a side view of another transmission assembly constructed according to the principles of the present invention, installed on an elliptical exercise apparatus, and configured so the handlebars are available for movement through a relatively small range of motion.
Figure 35:
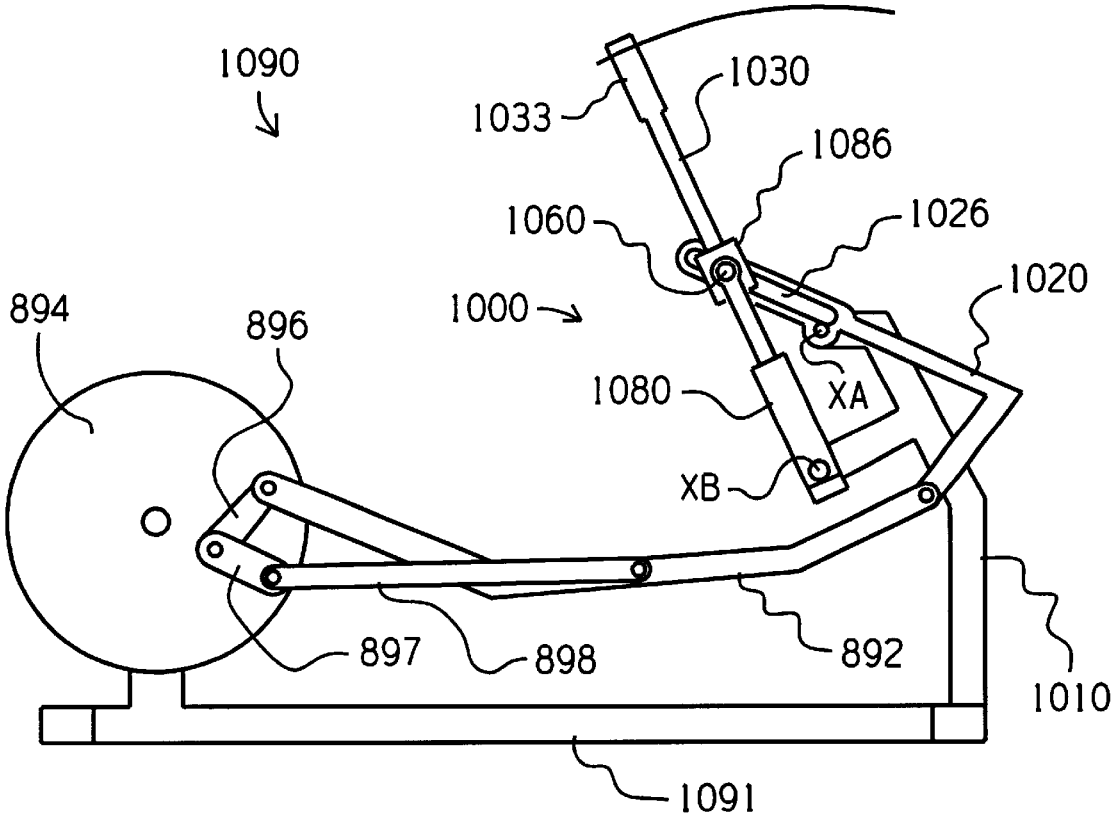
FIG. 35 is a side view of the transmission assembly and elliptical exercise apparatus of FIG. 34, but configured so the handlebars are available for movement through a relatively large range of motion.

Another embodiment of the present invention is designated as 1000 and shown on an elliptical exercise machine 1090 in FIGS. 34–35. Generally speaking, the assembly 1000 is similar to the assembly 900, but with telescoping members 1080 substituted for the motorized adjustment assemblies. FIG. 34 shows the assembly 1000 configured for minimum displacement of the arm driven member 1030, and FIG. 35 shows the assembly 1000 configured for maximum displacement of the arm driven member 1030. Only one side of the assembly 1000 and the machine 1090 is shown for ease of illustration. The exercise apparatus 1090 includes a frame 1091 designed to rest upon a floor surface, and the same cranks 894, floating cranks 896, foot supporting links 892, crank extensions 897, and drawbar links 898.

On each side of the assembly 1000, the leg driven member 1020 is pivotally connected to the frame 1091 at pivot axis XA, and the arm driven member 1030 is pivotally connected to the frame 1091 at pivot axis XB. A race or slot 1026 is provided in an upper portion of the leg member 1020 to accommodate a peg 1060 on a coupling member 1086. The coupling member 1086 is slidable along an intermediate portion of the arm member 1030 and rigidly secured to the rod end of a telescoping member 1080. An opposite, cylinder end of the telescoping member 1080 is rigidly secured to the lower end of the arm member 1030 and/or pivotally connected to the frame 1091 at the pivot axis XB.

The peg 1060 links pivoting of the leg driven member 1020 to pivoting of the arm driven member 1030. As the peg 1060 is moved toward the pivot axis XA (see FIG. 34), the angular displacement of the arm driven member 1030 approaches zero, because the peg 1060 moves through a relatively short arc, if any. On the other hand, as the peg 1060 is moved away from the pivot axis XA (see FIG. 35), the angular displacement of the arm driven member 1030 increases, because the peg 1060 moves through a relatively longer arc. The telescoping member 1080 is similar to the telescoping member 180, and the peg 1060 is pulled away from the pivot axis XA by user applied force sufficient to overcome a spring and a damper.

Figure 36:
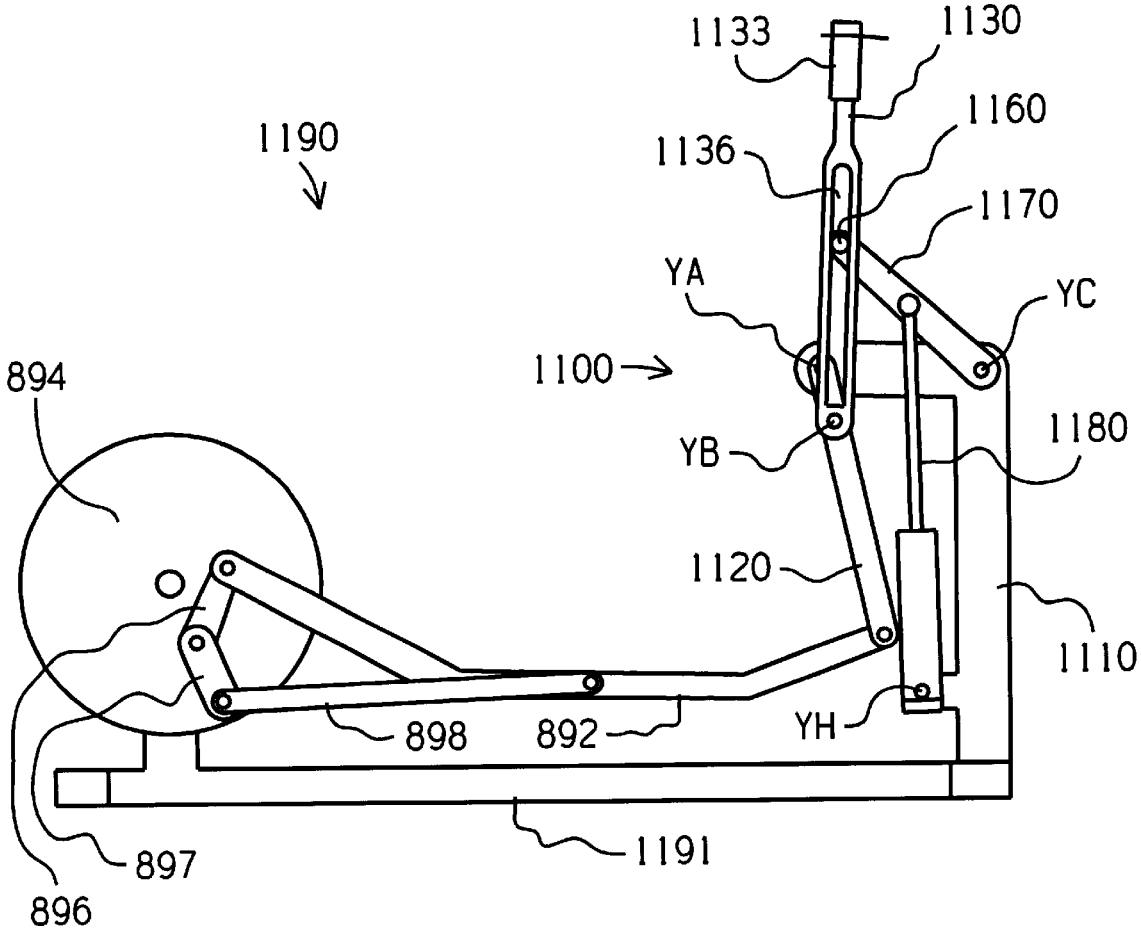
FIG. 36 is a side view of another transmission assembly constructed according to the principles of the present invention, installed on an elliptical exercise apparatus, and configured so the handlebars are available for movement through a relatively small range of motion.
Figure 37:
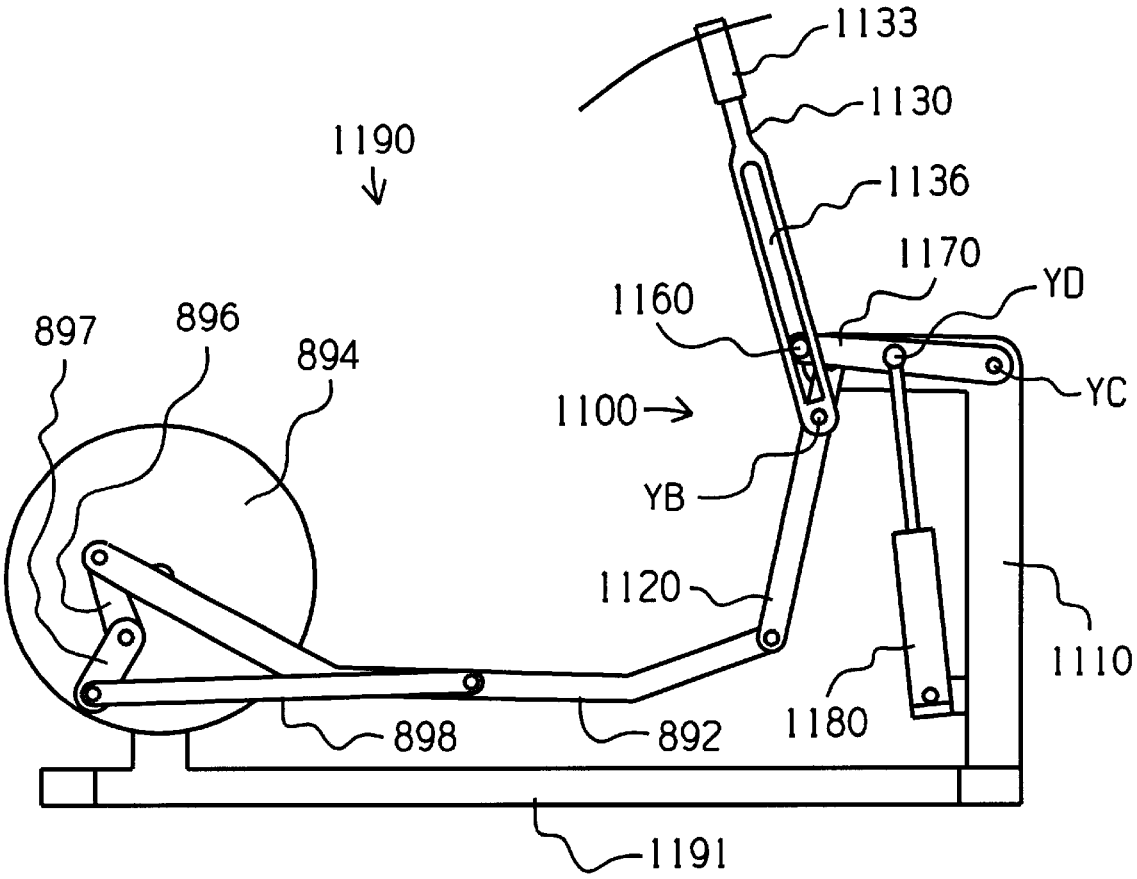
FIG. 37 is a side view of the transmission assembly and elliptical exercise apparatus of FIG. 36, but configured so the handlebars are available for movement through a relatively large range of motion.

Another embodiment of the present invention is designated as 1100 and shown on an elliptical exercise machine 1190 in FIGS. 36–37. Generally speaking, this embodiment 1100 demonstrates that one of the leg driven member 1120 and the arm driven member 1130 may be pivotally mounted on the other, rather than directly on the frame 1191. FIG. 36 shows the assembly 1100 configured for minimum displacement of the arm driven member 1130, and FIG. 37 shows the assembly 1100 configured for maximum displacement of the arm driven member 1130. Only one side of the assembly 1100 and the machine 1190 is shown for ease of illustration. The exercise apparatus 1190 includes a frame 1191 designed to rest upon a floor surface, and the same cranks 894, floating cranks 896, foot supporting links 892, crank extensions 897, and drawbar links 898.

On each side of the assembly 1100, an upper end of the leg driven member 1120 is pivotally connected to frame member or stanchion 1110 at pivot axis YA, and a lower end of the arm driven member 1130 is pivotally connected to an intermediate portion of the leg driven member 1120 at pivot axis YB. A race or slot 1136 is provided in an intermediate portion of the arm member 1130 to accommodate a peg 1160 which extends from a distal end of a support link 1170. An opposite end of the support link 1170 is pivotally connected to the frame 1191 at pivot axis YC. A telescoping member 1180 has a rod end pivotally connected to an intermediate portion of the support link 1170 at pivot axis YD, and an opposite, cylinder end pivotally connected to the frame 1191 at pivot axis YH. The telescoping member 1180 includes a spring and a damper, and is functionally similar to the telescoping member 180.

On this embodiment 1100, the peg 1160 may be described as a fulcrum. When the peg 1160 occupies a position approximately midway between the handle 1133 and the pivot axis YB (see FIG. 36), the range of motion of the handle 1133 is comparable to the range of motion of the pivot axis YB. On the other hand, as the peg 1160 is moved closer to the pivot axis YB (see FIG. 37), the range of motion of the handle 1133 is amplified relative to the range of motion of the pivot axis YB.

Figure 38:
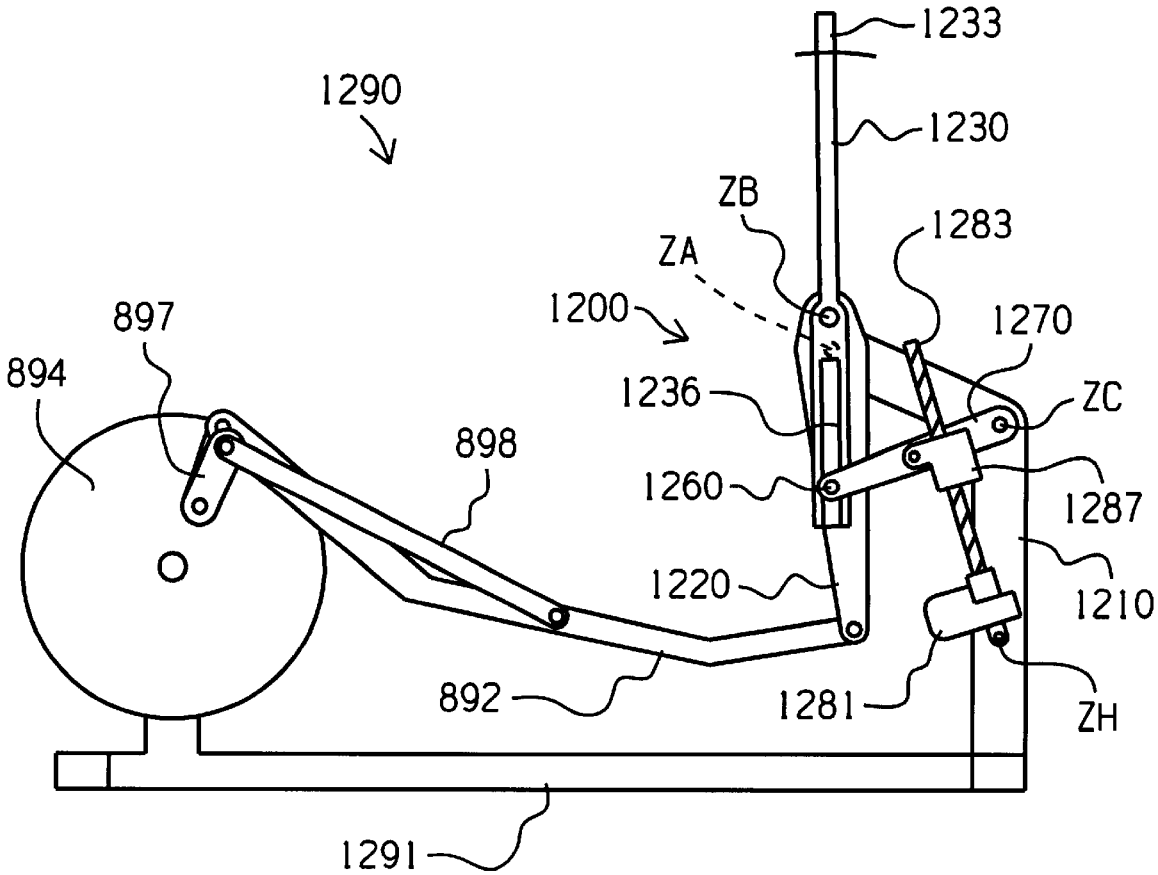
FIG. 38 is a side view of another transmission assembly constructed according to the principles of the present invention, installed on an elliptical exercise apparatus, and configured so the handlebars are available for movement through a relatively small range of motion.
Figure 39:
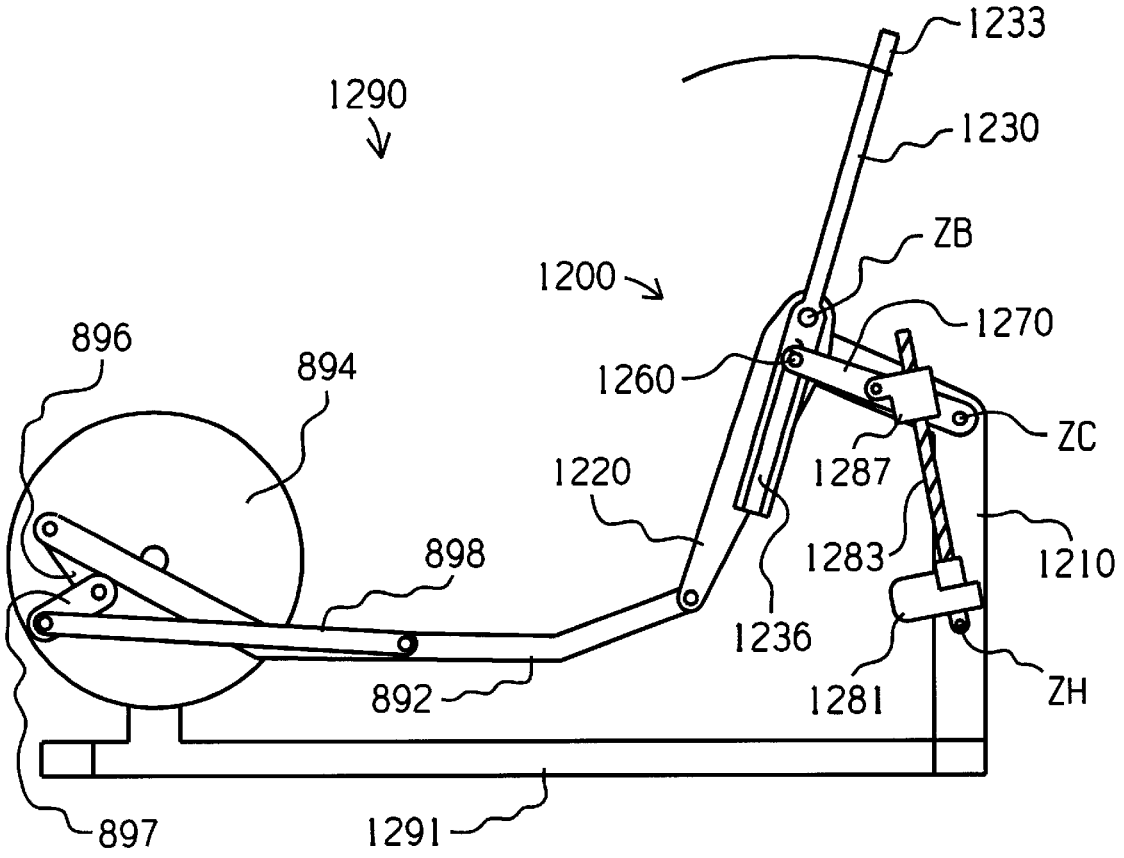
FIG. 39 is a side view of the transmission assembly and elliptical exercise apparatus of FIG. 38, but configured so the handlebars are available for movement through a relatively large range of motion.

Another embodiment of the present invention is designated as 1200 and shown on an elliptical exercise machine 1290 in FIGS. 38–39. Generally speaking, the assembly 1200 is similar to the assembly 1100, except that the relative locations of the pivot axes for the leg driven member 1220 and the arm driven member 1230 have been reversed, and motorized adjustment assemblies have been substituted for the telescoping members 1180. FIG. 38 shows the assembly 1200 configured for minimum displacement of the arm driven member 1230, and FIG. 39 shows the assembly 1200 configured for maximum displacement of the arm driven member 1230. Only one side of the assembly 1200 and the machine 1290 is shown for ease of illustration. The exercise apparatus 1290 includes a frame 1291 designed to rest upon a floor surface, and the same cranks 894, floating cranks 896, foot supporting links 892, crank extensions 897, and drawbar links 898.

On each side of the assembly 1200, an intermediate portion of the leg driven member 1220 is pivotally connected to frame member or stanchion 1210 at pivot axis ZA, and an intermediate portion of the arm driven member 1230 is pivotally connected to an upper end of the leg driven member 1220 at pivot axis ZB. A race or slot 1236 is provided in a lower distal portion of the arm member 1230 to accommodate a peg 1260 which projects from a distal end of a support link 1270. An opposite end of the support link 1270 is pivotally connected to the frame 1291 at pivot axis ZC. A coupling member 1287 is pivotally connected to an intermediate portion of the support link 1270, and is threadably mounted on an upper distal portion of a lead screw 1283. An opposite, lower end of the lead screw 1283 is operatively connected to a motor 1281 which is pivotally mounted on the frame 1291 at pivot axis ZH.

As on the previous embodiment 1100, the peg 1260 serves as a fulcrum. When the peg 1260 is relatively far from the pivot axis ZA (see FIG. 38), the range of motion of the handle 1233 is relatively small because the relatively long radius of curvature constrains the handle 1233 to remain approximately vertical. On the other hand, as the peg 1260 is moved closer to the pivot axis ZA (see FIG. 39), the range of motion of the handle 1233 is relatively larger because the relatively shorter radius of curvature allows the handle 1233 to pivot almost to the same extent as the leg member 1220. As on other embodiments described above, the location of the peg 1260 is selectively adjusted by operation of the motor 1281 in response to a control signal from the user and/or a controller.

Figure 40:
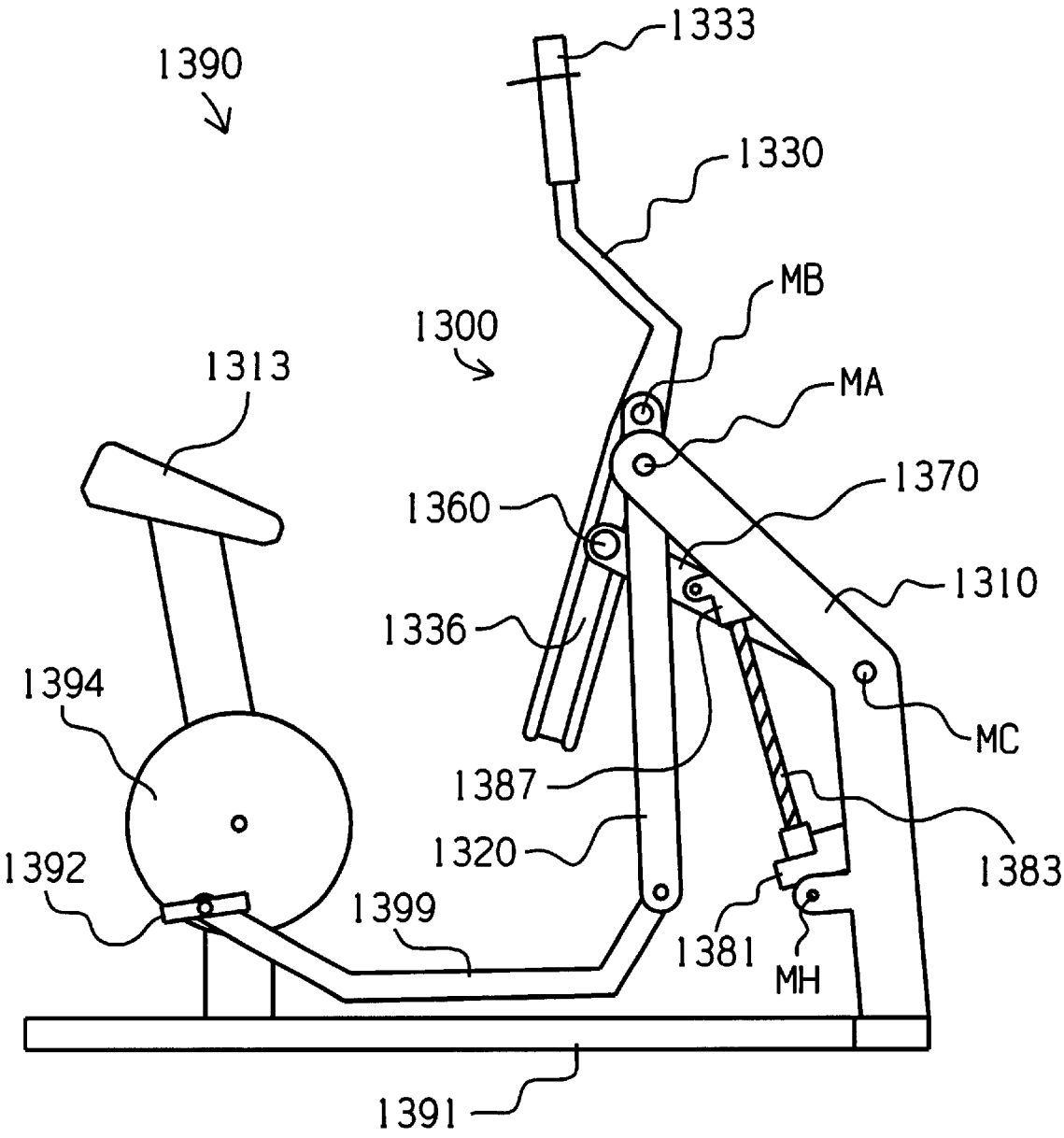
FIG. 40 is a side view of a transmission assembly like the transmission assembly of FIGS. 38–39, but installed on a stationary bicycle exercise apparatus.

Another embodiment of the present invention.is designated as 1300 and shown on a stationary bicycle machine 1390 in FIG. 40. The assembly 1300 is similar to the assembly 1200 and included primarily to emphasize that the present invention is suitable for use on various types of exercise equipment and/or in connection with various types of exercise motions. FIG. 40 shows the assembly 1300 configured for moderate displacement of the arm driven member 1330. Only one side of the assembly 1300 and the machine 1390 is shown for ease of illustration. The exercise apparatus 1390 includes a frame 1391 designed to rest upon a floor surface; left and right cranks 1394 rotatably mounted on the frame 1391; left and right pedals 1392 rotatably mounted on respective cranks 1394; and left and right drawbar links 1399 pivotally interconnected between respective cranks 1394 and respective leg driven members 1320. The drawbar links 1399 link rotation of the pedals 1392 to pivoting of the leg driven members 1320.

On each side of the assembly 1300, an intermediate portion of the leg driven member 1320 is pivotally connected to frame member or stanchion 1310 at pivot axis MA, and an intermediate portion of the arm driven member 1330 is pivotally connected to an upper end of the leg driven member 1320 at pivot axis MB. A race or slot 1336 is provided in a lower distal portion of the arm member 1330 to accommodate a peg 1360 which projects from a distal end of a support link 1370. An opposite end of the support link 1370 is pivotally connected to the frame 1391 at pivot axis MC. A coupling member 1387 is pivotally connected to an intermediate portion of the support link 1370, and is threadably mounted on an upper distal portion of a lead screw 1383. An opposite, lower end of the lead screw 1383 is operatively connected to a motor 1381 which is pivotally mounted on the frame 1391 at pivot axis MH. As on the previous embodiment 1200, the location of the peg 1360 is selectively adjusted by operation of the motor 1381, in response to a control signal from the user and/or a controller, to adjust the range of motion of the handle 1333.

Figure 41:
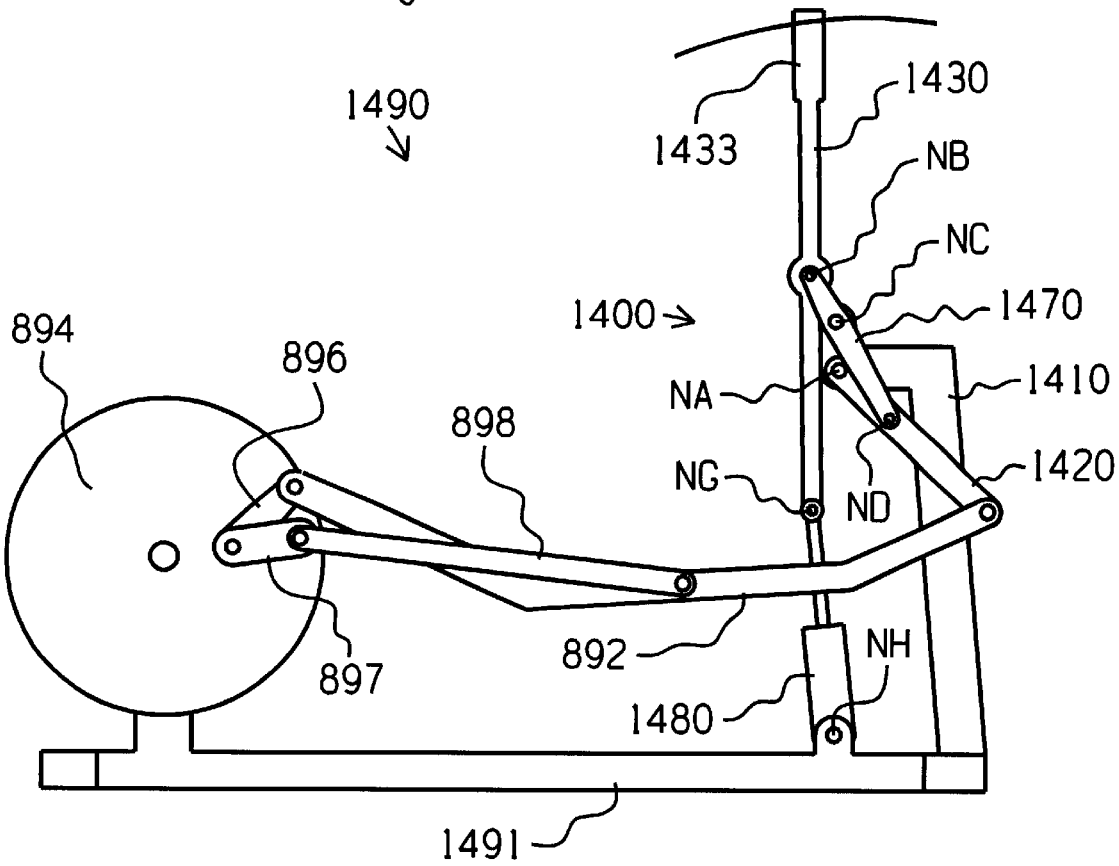
FIG. 41 is a side view of another transmission assembly constructed according to the principles of the present invention and installed on an elliptical exercise apparatus.

Another embodiment of the present invention is designated as 1400 and shown on an elliptical exercise machine 1490 in FIG. 41. Generally speaking, the assembly 1400 accommodates arm exercise motion which may be selectively lengthened whenever the arm driven member 1430 is moving away from a central, generally vertical position. FIG. 41 shows the arm driven member 1430 approximately aligned with the telescoping member (the depicted arc requires user applied force). Only one side of the assembly 1400 and the machine 1490 is shown for ease of illustration. The exercise apparatus 1490 includes a frame 1491 designed to rest upon a floor surface, and the same cranks 894, floating cranks 896, foot supporting links 892, crank extensions 897, and drawbar links 898.

On each side of the assembly 1400, an upper end of the leg driven member 1420 is pivotally connected to frame member or stanchion 1410 at pivot axis NA. A connecting link 1470 has an intermediate portion pivotally connected to the frame 1491 at pivot axis NC, and a lower end pivotally connected to the leg member 1420 at pivot axis ND. An intermediate portion of the arm driven member 1430 is pivotally connected to an opposite, upper end of the connecting link 1470 at pivot axis NB. A telescoping member 1480 has a rod end pivotally connected to a lower end of the arm member 1430 at pivot axis NG, and an opposite, cylinder end pivotally connected to the frame 1491 at pivot axis NH.

Having been configured to resist extension, the telescoping member 1480 resists being moved out of alignment with the arm driven member 1430. As a result, both the arm driven member 1430 and the telescoping member 1480 tend to remain approximately vertical in the absence of user applied force. On the other hand, with reference to the position shown in FIG. 41, for example, as the leg driven member 1420 moves rearward, it imparts a clockwise rotational force against the handle 1433, allowing the user to more readily push the handle 1433 forward during this phase of the exercise motion.

Figure 42:
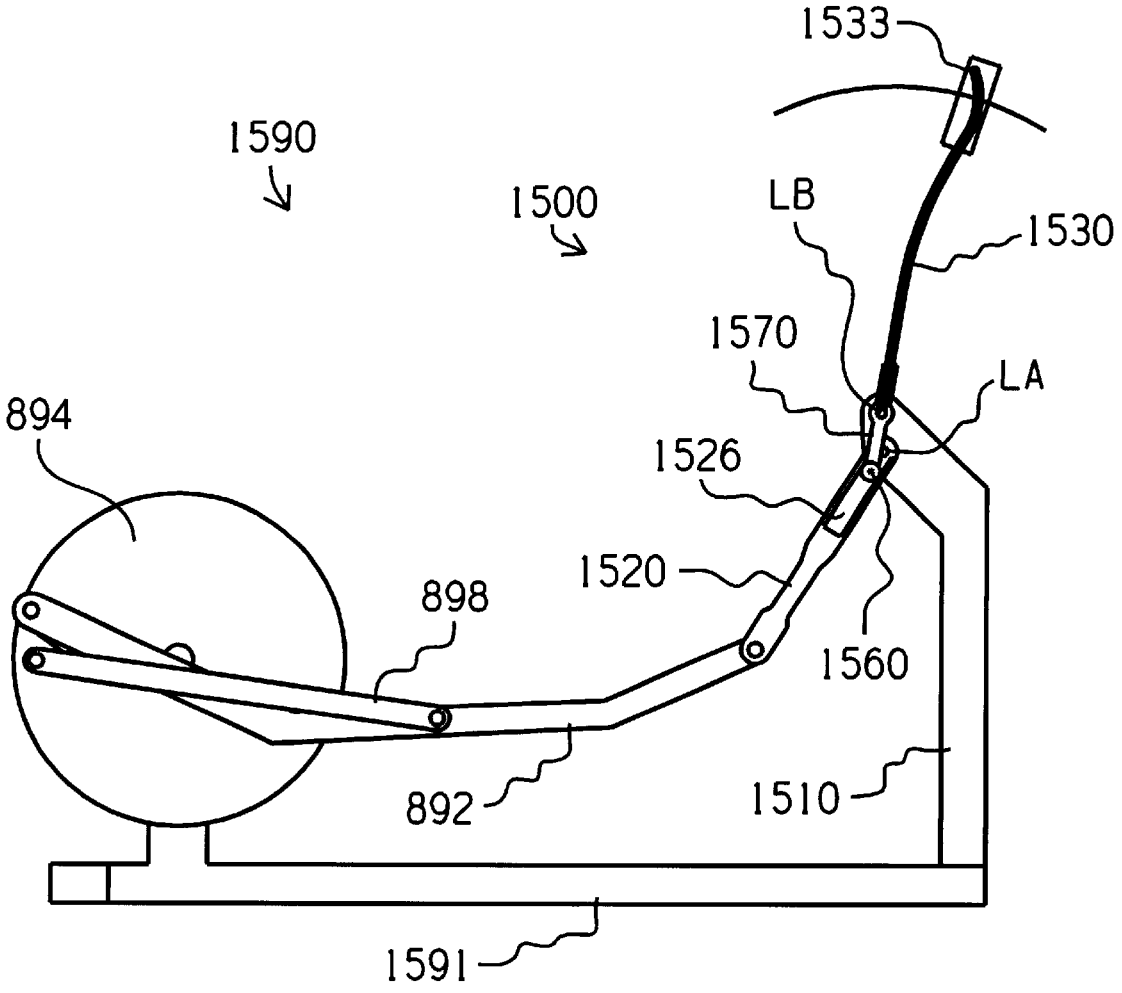
FIG. 42 is a side view of another transmission assembly constructed according to the principles of the present invention and installed on an elliptical exercise apparatus.

Another embodiment of the present invention is designated as 1500 and shown on an elliptical exercise machine 1590 in FIG. 42. Generally speaking, the assembly 1500 also accommodates arm exercise motion which may be selectively lengthened whenever the arm driven member 1530 is moving away from a central or intermediate position. FIG. 42 shows the arm driven member 1530 bent slightly forward (as a result of user applied force). Only one side of the assembly 1500 and the machine 1590 is shown for ease of illustration. The exercise apparatus 1590 includes a frame 1591 designed to rest upon a floor surface, and the same cranks 894, floating cranks 896, foot supporting links 892, crank extensions 897, and drawbar links 898.

On each side of the assembly 1500, an upper end of the leg driven member 1520 is pivotally connected to frame member or stanchion 1510 at pivot axis LA. A slot or race 1526 is provided along an intermediate portion of the leg driven member 1520 to accommodate a peg 1560. The peg 1560 projects from a lower end of a connecting link 1570. An opposite, upper end of the connecting link 1570 is pivotally connected to the frame 1591 at pivot axis LB. The arm driven member 1530 is a leaf spring having a lower end rigidly secured to the connecting link 1570. A handle 1533 is rigidly mounted on an opposite, upper end of the leaf spring 1530. In the absence of user applied force, both the leaf spring 1530 and the connector link 1570 pivot back and forth in synchronization with the leg driven member 1520. A user may apply force against the handle 1533 to increase or decrease its range of motion.

Figure 43:
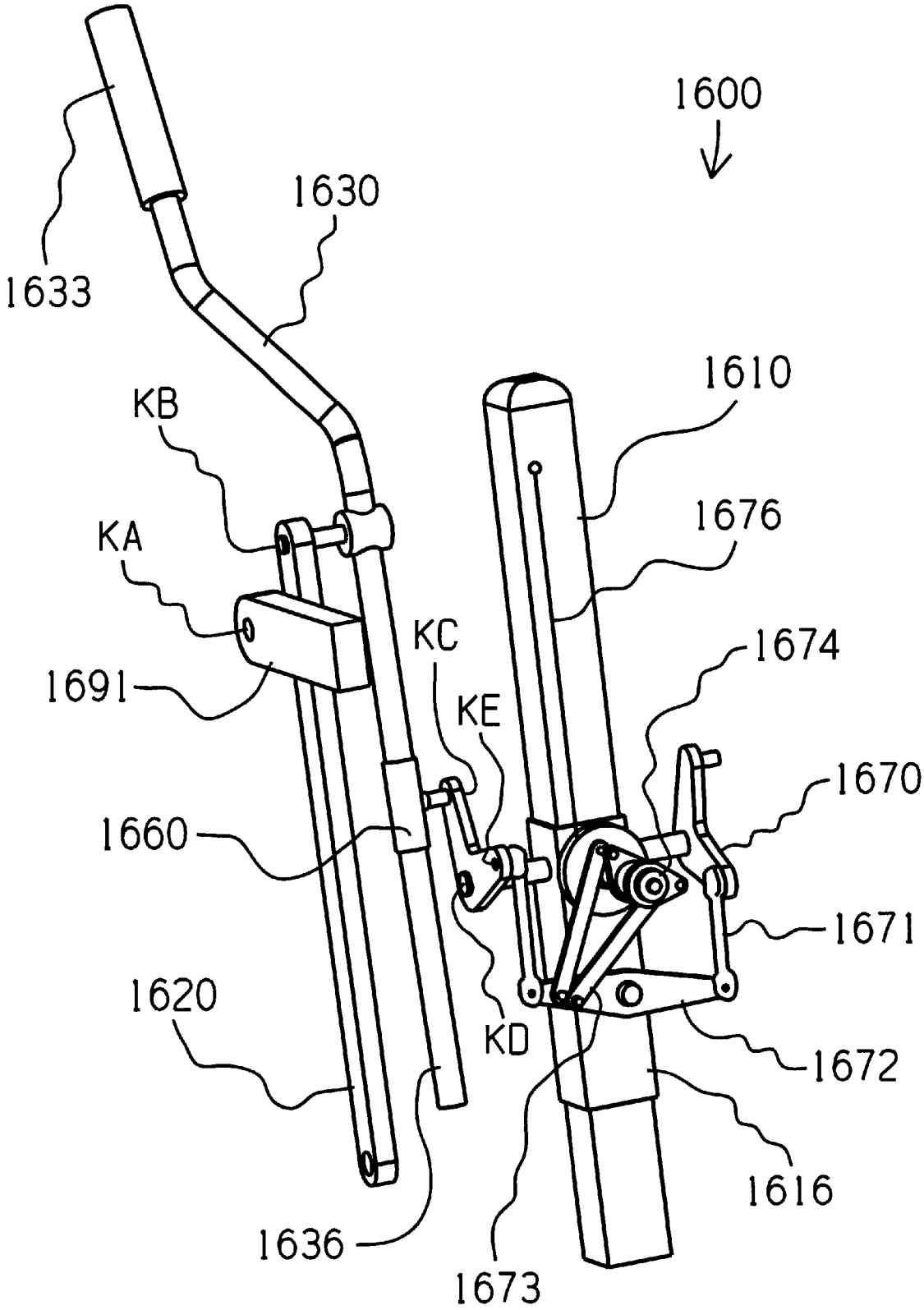
FIG. 43 is a side view of still another transmission assembly constructed according to the principles of the present invention.

Still another embodiment of the present invention is designated as 1600 in FIG. 43. Generally speaking, the assembly 1600 uses a ratchet-like mechanism to gradually increase the stroke of left and right arm driven members 1630 in response to user applied force against either or both of the arm driven members 1630. On each side of the assembly 1600, an intermediate portion of the leg driven member 1620 is pivotally connected to a portion of the frame 1691 at pivot axis KA. A lower end of the leg driven member 1620 is pivotally connected to a foot supporting link like any of those discussed above. An intermediate portion of the arm driven member 1630 is pivotally connected to an upper end of the leg driven member 1620 at pivot axis KB. A handle 1633 is rigidly mounted on an upper end of the arm driven member 1630.

On each side of the assembly 1600, the arm driven member 1630 has a lower end slidably disposed inside a sleeve or tube 1660 which is pivotally mounted on an end of a rocker link 1670 at pivot axis KC. An intermediate portion of the rocker link 1670 is pivotally mounted to a common support 1616 at pivot axis KD. The support 1616 is slidably mounted on a forward frame stanchion 1610. An opposite end of the rocker link 1670 is pivotally connected to a connector 1671 at pivot axis KE. An opposite end of the connector 1671 is pivotally connected to a respective end of a common lever 1672. The connector 1671 has swivel joints at its ends which cooperate with respective pivot axes to define universal joints. An intermediate portion of the common lever 1672 is pivotally connected to the support 1616.

A first ratchet link 1673 is pivotally interconnected between the left end of the common lever 1672 and a first clutch mounted on a rotatable shaft 1674. A second ratchet link 1673 is pivotally interconnected between the left end of the common lever 1672 and a second clutch mounted on the shaft 1674. The clutches are commercially available parts CDC-50-CW and CDC-50-CCW distributed by Machine Components Corporation of Plainview, N.Y. Generally speaking, each of the clutches is capable of transmitting a certain level of torque to the shaft 1674 in a single rotational direction. A drum 1675 is rigidly secured to the shaft 1674, and a cable 1676 has a first end wound about the drum 1675, and an opposite, second end secured to an upper end of the stanchion 1610. As the shaft 1674 and the drum 1675 are incrementally rotated counter-clockwise (in response to pivoting of the arm driven members 1630), the support 1616 is gradually pulled up along the stanchion 1610, thereby increasing the stroke of the handles 1633. Stops 1677 are provided near the top of the stanchion 1610 to impose an upper limit on movement of the support 1616 (in conjunction with a slip disc associated with the drum 1675). In the absence of user applied force against the handles 1633, the support 1616 is biased toward a lowermost position along the stanchion 1610 by gravity acting upon the support 1616 and the components supported thereby.

The foregoing embodiments are representative but not exhaustive examples of the subject invention. It is to be understood that the embodiments and/or their respective features may be mixed and matched in a variety of ways to arrive at other embodiments. For example, the control and/or display options described with reference to a particular embodiment are applicable to other embodiments, as well.

The present invention may also be described in functional terms along the following lines. On an exercise apparatus comprising a frame designed to rest upon a floor surface; a left arm driven member and a right arm driven member; and a left leg driven member and a right leg driven member, wherein at least one of each said leg driven member and each said arm driven member is pivotally connected to the frame, the present invention may be described in terms of (a) means for interconnecting each said leg driven member and a respective arm driven member in such a manner that the arm driven member is.synchronized with the leg driven member and movable through a range of motion which is variable independent of the leg driven member; (b) means for connecting each said leg driven member and a respective arm driven member in such a manner that the arm driven member is synchronized with the leg driven member and movable against a resistance force which is independent of the leg driven member; (c) means for connecting each leg driven member and a respective arm driven member in such a manner that during movement of the leg driven member, the arm driven member is selectively movable relative to the frame and constrained to remain synchronized with the leg driven member when moving relative to the frame; and/or (d) means for connecting each said leg driven member and a respective arm driven member in such a manner that the arm driven member is alternatively fixed to the frame and the leg driven member and always fixed to one of the frame and the leg driven member.

The present invention has been described with reference to specific embodiments and particular applications, which will lead those skilled in the art to recognize additional embodiments, modifications, and/or applications which fall within the scope of the present invention. Among other things, the principles of the present invention are also suitable for making "on the fly" adjustments to leg exercise motion. Accordingly, the scope of the present invention is to be limited only to the extent of the claims which follow.

What is claimed is:

1. An exercise apparatus, comprising:

a frame designed to rest upon a floor surface;

a left leg driven member and a right leg driven member, wherein each said leg driven member is movably connected to the frame;

a left arm driven member and a right arm driven member;

a means for interconnecting each said arm driven member and a respective leg driven member in such a manner that during movement of each said leg driven member through a leg stroke length, each said arm driven member is both synchronized with a respective leg driven member and movable through an arm stroke length which is variable independent of the leg stroke length.

2. The exercise apparatus of claim 1, further comprising a left crank and a right crank, wherein each said crank is rotatably mounted on the frame and linked to a respective leg driven member.

3. The exercise apparatus of claim 2, wherein a left foot supporting link is movably interconnected between the left crank and the left leg driven member, and a right foot supporting link is movably interconnected between the right crank and the right leg driven member.

4. The exercise apparatus of claim 3, wherein each said leg driven member is pivotally connected to the frame.

5. The exercise apparatus of claim 4, wherein a respective handle is connected to an upper end of each said arm driven member.

6. The exercise apparatus of claim 1, wherein the means also interconnects each said arm driven member and a respective leg driven member in such a manner that during movement of each said leg driven member, the respective arm driven member is capable of remaining stationary relative to the frame.

7. The exercise apparatus or claim 1, wherein the means also interconnects each said arm driven member and a respective leg driven member in such a manner that each said arm driven member is constrained to always be in one of two modes, including a first mode fixed against movement relative to the frame, and a second mode constrained to move in synchronous fashion together with the respective leg driven member.

8. The exercise apparatus of claim 1, wherein the means adjusts the range of motion of at least one said arm driven member in response to a control signal generated by an electronic device on the apparatus.

9. An exercise apparatus, comprising:

a frame designed to rest upon a floor surface;

a left leg driven member and a right leg driven member, wherein each said leg driven member is movably connected to the frame;

a left arm driven member and a right arm driven member;

a means for connecting each said arm driven member and a respective leg driven member in such a manner that during movement of the respective leg driven member, the arm driven member is both (a) selectively movable relative to the frame, and (b) constrained to remain synchronized with the respective leg driven member when moving relative to the frame.

10. The exercise apparatus of claim 9, further comprising a left crank and a right crank, wherein each said crank is rotatably mounted on the frame and linked to a respective leg driven member.

11. The exercise apparatus of claim 10, wherein a left foot supporting link is movably interconnected between the left crank and the left leg driven member, and a right foot supporting link is movably interconnected between the right crank and the right leg driven member.

12. The exercise apparatus of claim 11, wherein each said leg driven member is pivotally connected to the frame.

13. The exercise apparatus of claim 12, wherein a respective handle is connected to an upper end of each said arm driven member.

14. The exercise apparatus of claim 9, wherein the means also interconnects each said arm driven member and a respective leg driven member in such a manner that each said arm driven member is constrained to always be in one of two modes, including a first mode fixed against movement relative to the frame, and a second mode constrained to move in synchronous fashion together with the respective leg driven member.

15. The exercise apparatus of claim 9, wherein the means switches at least one said arm driven member from a stationary mode to a moving mode in response to a control signal generated by an electronic device on the apparatus.

16. An exercise apparatus, comprising:

a frame designed to rest upon a floor surface;

a left leg driven member and a right leg driven member, wherein each said leg driven member is movably connected to the frame;

a left arm driven member and a right arm driven member; and a means for connecting each said arm driven member and a respective leg driven member in such a manner that the arm driven member is constrained to always be in one of two modes, including a first mode fixed against movement relative to the frame, and a second mode constrained to move in synchronous fashion together with the respective leg driven member.

17. The exercise apparatus of claim 16, further comprising a left crank and a right crank, wherein each said crank is rotatably mounted on the frame and linked to a respective leg driven member.

18. The exercise apparatus of claim 17, wherein a separate foot supporting link is movably interconnected between each said crank and a respective leg driven member.

19. The exercise apparatus of claim 18, wherein each said leg driven member is pivotally connected to the frame.

20. The exercise apparatus of claim 19, wherein a respective handle is connected to an upper end of each said arm driven member.

21. The exercise apparatus of claim 16, wherein the means switches between modes in response to a control signal generated by an electronic device on the apparatus.

* * * * *